US010942463B2

(12) United States Patent
Yoshiba et al.

(10) Patent No.: US 10,942,463 B2
(45) Date of Patent: Mar. 9, 2021

(54) TONER

(71) Applicant: CANON KABUSHIKI KAISHA, Tokyo (JP)

(72) Inventors: Daisuke Yoshiba, Suntou-gun (JP); Hiroki Akiyama, Toride (JP); Koji Nishikawa, Susono (JP); Shotaro Nomura, Suntou-gun (JP); Katsuhisa Yamazaki, Numazu (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/680,814

(22) Filed: Nov. 12, 2019

(65) Prior Publication Data

US 2020/0081361 A1 Mar. 12, 2020

Related U.S. Application Data

(63) Continuation of application No. 14/939,486, filed on Nov. 12, 2015, now abandoned.

(30) Foreign Application Priority Data

Nov. 18, 2014 (JP) ..... 2014-233276
Oct. 15, 2015 (JP) ..... 2015-203800

(51) Int. Cl.
*G03G 9/08* (2006.01)
*G03G 9/087* (2006.01)

(52) U.S. Cl.
CPC ..... *G03G 9/08755* (2013.01)

(58) Field of Classification Search
CPC ..... G03G 9/08755
USPC ..... 430/109.4
See application file for complete search history.

(56) References Cited

U.S. PATENT DOCUMENTS 5,578,409 A 11/1996 Kotaki
5,660,963 A 8/1997 Doujo et al.
5,976,752 A 11/1999 Matsunaga et al.
7,582,401 B2 9/2009 Ogawa et al.
7,745,089 B2 6/2010 Okubo et al.
8,865,385 B2 10/2014 Nakayama et al.
9,097,997 B2 8/2015 Nomura et al.
9,097,998 B2 8/2015 Yamazaki et al.
9,829,818 B2 11/2017 Yoshiba et al.
2005/0227160 A1 10/2005 Shirai
2006/0014094 A1 1/2006 Yuasa et al.
2010/0297547 A1 11/2010 Hirota et al.
2013/0108954 A1 5/2013 Tsujimoto et al.
2013/0244166 A1 9/2013 Yamazaki et al.
2013/0252167 A1 9/2013 Moribe et al.
2014/0004460 A1 1/2014 Yoshiba et al.
2015/0037722 A1 2/2015 Yamazaki et al.
2015/0037729 A1 2/2015 Yoshiba et al.

FOREIGN PATENT DOCUMENTS

CN 1150661 A 5/1997
CN 1218203 6/1999
CN 1711507 12/2005
JP 7-175263 A 7/1995
JP 3-146303 A 6/1997
JP H09-146303 A 6/1997
JP 2007-133391 A 5/2007
JP 2012-78810 A 4/2012
JP 2012-215859 A 11/2012
JP 2013-97262 A 5/2013

*Primary Examiner* — Mark A Chapman
(74) *Attorney, Agent, or Firm* — Venable LLP

(57) ABSTRACT

A toner including a toner particle containing a polyester resin composition, wherein i) the polyester resin composition contains a specific aliphatic hydrocarbon and a polyester resin having at a terminal a structure derived from at least one of a specific alkyl monoalcohol and a specific alkyl monocarboxylic acid, and ii) the total content of the aliphatic hydrocarbon, the structure derived from the alkyl monoalcohol, and the structure derived from the alkyl monocarboxylic acid is 2.5 to 10.0% by mass, wherein, in the temperature-endothermic quantity curve of the polyester resin composition obtained by DSC, an endothermic peak is present in a specific temperature range and an endothermic quantity for this endothermic peak is 0.10 to 1.90 J/g.

10 Claims, No Drawings

TONER

This application is a continuation of U.S. patent application Ser. No. 14/939,486 filed Nov. 12, 2015, which in turn claims the benefit of Japanese Patent Application No. 2014-233276 filed Nov. 18, 2014, and Japanese Patent Application No. 2015-203800 filed Oct. 15, 2015, each of which is hereby incorporated by reference herein in its entirety.

BACKGROUND OF THE INVENTION

Field of the Invention

The present invention relates to a toner used in recording methods such as electrophotographic methods.

Description of the Related Art

Additional improvements in the low-temperature fixability of the toner in electrophotographic devices have been sought in recent years in order to achieve greater energy savings. On the other hand, efforts to increase the print speed are also going forward, and there is desire for the improvements in low-temperature fixability to co-exist in good balance with the corresponding increases in the print speed.

A low-melting wax that exhibits an excellent functionality is frequently used in order to improve the low-temperature fixability. This low-melting wax is a crystalline material that has a melting point from 60.0° C. to 90.0° C., and examples here include aliphatic hydrocarbon waxes and ester waxes.

This low-melting wax brings about an improvement in the low-temperature fixability by melting rapidly itself at its melting point and also by plasticizing the amorphous resin that is the main binder, during fixing.

However, the low-melting waxes have low molecular weights, and due to this they are prone to volatilization under the application of heat. As a result, a volatile component is readily produced when a toner containing a low-melting wax is heated during the fixing process. This volatile component, upon contact with a structural member within the image-forming apparatus and in particular upon contact with a low-temperature area of the fixing unit, is cooled and undergoes deposition, and contamination of the fixing unit readily occurs due to the accumulation of the deposited material.

With regard to this contamination of the fixing unit, there is a tendency for the contamination to occur ever more easily in particular as the print speed is increased. This is due to the following: a relatively high fixation temperature is set in a high-print-speed fixing process given the necessity for bringing about an instantaneous melting of the toner within the fixing nip, and as a consequence an excess amount of heat is readily applied to the toner.

In order to suppress the volatile component and suppress fixing unit contamination, Japanese Patent Application Laid-open No. 2012-78810 proposes the specification of the total amount of the component that is produced when a hydrocarbon wax is heated for 10 minutes at 200° C. It is stated that, by doing this, volatilization of the wax component can be suppressed and the state of contamination around the fixing unit can be improved.

Similarly, Japanese Patent Application Laid-open No. 2012-215859 proposes an inhibition of dust generation by specifying the ratio between modified wax and ester wax.

Proposals have also been made, on the other hand, with regard to art in which a long-chain alkyl component, which acts as a low-melting wax, is used chemically bonded to the amorphous resin that is the main binder.

The generation of a volatile component during fixing can be suppressed by this bonding of a low-melting component to the main binder because the apparent molecular weight is increased, while the functionality of a low-melting wax is also present.

Japanese Patent Application Laid-open No. H7-175263 proposes a toner for electrostatic image development that contains a polyester resin that has been at least partially modified by a compound having a hydroxyl group or carboxyl group in terminal position and having a $C_{22-102}$ long-chain alkyl group. Japanese Patent Application Laid-open No. 2013-97262 proposes a toner that uses a polyester unit obtained by the reaction of a long-chain alcohol having from 16 to 102 carbons, a polyhydric alcohol, and a polybasic carboxylic acid. Japanese Patent Application Laid-open No. 2007-133391 proposes a toner binder resin containing a polyester resin that contains a compound that has a functional group capable of reacting with acid or alcohol and a long-chain alkyl group having at least 30 carbons.

SUMMARY OF THE INVENTION

According to the results of investigations by the present inventors, the toners described in Japanese Patent Application Laid-open Nos. 2012-78810 and 2012-215859 required further improvement with regard to suppressing fixing unit contamination during use at higher print speeds and in a high fixation temperature environment.

The following problem was found with respect to Japanese Patent Application Laid-open Nos. H7-175263, 2013-97262, and 2007-133391. In the examples in these documents, for example, a modified polyester resin is obtained by the addition during polyester polymerization of a monohydric long-chain alkyl alcohol monomer having a carbon chain length of 50. A long carbon chain length alcohol or acid monomer, such as the monohydric long-chain alkyl alcohol monomer having a carbon chain length of 50 used here, is obtained through the following process.

For example, in the case of a monohydric long-chain alkyl alcohol having a carbon chain length of 50, an aliphatic hydrocarbon (paraffin wax) having a carbon chain length of approximately 50 is oxidized.hydrolyzed to obtain the alcohol modification.

However, the conventional modified alcohol product provided by this modification reaction has had a modification rate of about 50 to 70% and the unmodified aliphatic hydrocarbon has been present in large amounts.

The alcohol-modified aliphatic hydrocarbon component reacts with the polyester resin during the polymerization reaction and is incorporated into the polyester resin. The unmodified aliphatic hydrocarbon component, on the other hand, does not contain a site reactive with the main binder and as a consequence is then present in a free state in the main binder, and this can be generated as a volatile component during fixing. Due to this, the art disclosed in these documents is art for which there is still room for improvement from the standpoint of the low modification rate of the hydrocarbon component.

In accordance with the preceding, a problem for the present invention is to provide a toner that, even in a high speed, long-run use environment, exhibits an excellent low-temperature fixability and little contamination of members such as the fixing unit and so forth.

The present invention relates to a toner that has a toner particle that contains a polyester resin composition, wherein the polyester resin composition contains i) a polyester resin having a structure at a terminal thereof, the structure derived from at least one of a long-chain alkyl monoalcohol having an average carbon number of 27 to 50 and a long-chain alkyl monocarboxylic acid having an average carbon number of 27 to 50; and an aliphatic hydrocarbon having an average carbon number of 27 to 50, and ii) the total content of the aliphatic hydrocarbon, the structure derived from the long-chain alkyl monoalcohol, and the structure derived from the long-chain alkyl monocarboxylic acid is from 2.5% by mass to 10.0% by mass with respect to the mass of the polyester resin composition, wherein, in an endothermic curve of the polyester resin composition measured by differential scanning calorimetric (DSC), a peak top temperature of an endothermic peak in the polyester resin composition is from 60.0° C. to 90.0° C., and an endothermic quantity of the endothermic peak is from 0.10 J/g to 1.90 J/g.

The present invention can provide a toner that, even in a high speed, long-run use environment, exhibits an excellent low-temperature fixability and little contamination of members such as the fixing unit and so forth.

Further features of the present invention will become apparent from the following description of exemplary embodiments.

DESCRIPTION OF THE EMBODIMENTS

The toner of the present invention is a toner that has a toner particle that contains a polyester resin composition, wherein i) the polyester resin composition contains a polyester resin having a structure at a terminal thereof, the structure derived from at least one of a long-chain alkyl monoalcohol having an average carbon number of 27 to 50 and a long-chain alkyl monocarboxylic acid having an average carbon number of 27 to 50, and an aliphatic hydrocarbon having an average carbon number of 27 to 50.

ii) The total content of the aliphatic hydrocarbon having an average carbon number of 27 to 50, the structure derived from the long-chain alkyl monoalcohol having an average carbon number of 27 to 50, and the structure derived from the long-chain alkyl monocarboxylic acid having an average carbon number of 27 to 50, is from 2.5% by mass to 10.0% by mass with respect to the mass of the polyester resin composition.

In addition, in the endothermic quantity curve of the polyester resin composition measured by differential scanning calorimetric (DSC), a peak top temperature of an endothermic peak in the polyester resin composition is characteristically from 60.0° C. to 90.0° C. and the endothermic quantity of the endothermic peak in the polyester resin composition is characteristically from 0.10 J/g to 1.90 J/g.

Styrene-acrylic resins and polyester resins are known for the main binder (binder resin) of toners, but polyester resin is preferably used in the toner of the present invention for its excellent durability and excellent low-temperature fixability.

In the present invention, polyester resin indicates a resin in which at least 50% by mass of the constituent components of the resin is composed of a polyester resin or a polyester segment.

As a result of intensive investigations in order to provide a toner that, even in a high speed, long-run use environment, has an excellent low-temperature fixability and little contamination of members such as the fixing unit and so forth, the present inventors discovered that the aforementioned problem could be solved by the following constitution. That is, the polyester resin composition contains a prescribed amount of a long-chain alkyl component having an average carbon number of 27 to 50. In addition, in the endothermic curve of the polyester resin composition obtained by differential scanning calorimetric measurement, the peak top temperature of an endothermic peak is 60.0° C. or more and 90.0° C. or less and the endothermic quantity of the endothermic peak is 0.10 J/g or more and 1.90 J/g or less.

The constitution of the present invention is described in detail herebelow.

A first characteristic feature of the polyester resin composition is that i) it contains a polyester resin having at a terminal a structure derived from at least one of a long-chain alkyl monoalcohol having an average carbon number of 27 to 50 and a long-chain alkyl monocarboxylic acid having an average carbon number of 27 to 50, and also contains an aliphatic hydrocarbon having an average carbon number of 27 to 50.

Through the use, in accordance with the preceding, of a polyester resin having in terminal position a structure derived from at least one of a long-chain alkyl monoalcohol having an average carbon number of 27 to 50 and a long-chain alkyl monocarboxylic acid having an average carbon number of 27 to 50, the aliphatic hydrocarbon component, which is prone to form a volatile component, can then be bonded to the main binder and contamination of, e.g., the fixing unit and so forth, can be suppressed.

In addition, the insertion of the aliphatic hydrocarbon component (long-chain alkyl component) into the main binder supports a more rapid appearance of the plasticizing effect than for a constitution in which the long-chain alkyl component and main binder are present separately. Due to this, it is critical for a high print speed system that the long-chain alkyl component be inserted in the main binder at a high conversion.

In order to obtain these effects, the average value of the carbon number in the long-chain alkyl component is from 27 to 50. The average value of the carbon number approximately corresponds to the melting point of the long-chain alkyl component. The melting point is preferably 60.0° C. or more and 90.0° C. or less in order to effectively exhibit a low-temperature fixability. The average carbon number that corresponds to this melting point range in the present invention is 27 to 50.

When the average carbon number is less than 27, the melting point of the long-chain alkyl component is then likely to fall below 60.0° C. and the toner will be prone to suffer from a deterioration in its storage stability. When, on the other hand, the average carbon number exceeds 50, the melting point is then likely to exceed 90.0° C. and it will be difficult to produce an effect on the low-temperature fixability.

The polyester resin composition according to the present invention characteristically contains a polyester resin having at a terminal a structure derived from at least one of a long-chain alkyl monoalcohol and a long-chain alkyl monocarboxylic acid having the previously indicated average carbon number, and also an aliphatic hydrocarbon having the previously indicated average carbon number. Here, this polyester resin having at a terminal a structure derived from at least one of a long-chain alkyl monoalcohol and a long-chain alkyl monocarboxylic acid denotes a resin in which a long-chain alkyl component has been inserted by reaction into polyester resin that is a main binder component. The aliphatic hydrocarbon component having the previously indicated average carbon number indicates, on the other hand, that the unmodified component—from the modification of the long-chain alkyl component into the alcohol or acid—is also present.

That is, the meaning here is that the polyester resin composition of the present invention contains polyester resin in which a long-chain alkyl component has been inserted and also contains the aliphatic hydrocarbon component that is the unmodified form of the long-chain alkyl component.

The average carbon number in the long-chain alkyl component is determined by the following method in the present invention.

The distribution of the carbon number in the long-chain alkyl component is measured as follows by gas chromatography (GC). 10 mg of the sample is exactly weighed out and introduced into a sample vial. 10 mg of exactly weighed hexane is added to this sample vial and the lid is put on followed by heating to a temperature of 150° C. on a hot plate and mixing. After this, and in a state in which the long-chain alkyl component has not precipitated, this sample is injected into the injection port of a gas chromatograph and analysis is performed to obtain a chart in which the horizontal axis is the carbon number and the vertical axis is the signal strength. Then, using the obtained chart, the percentage for the peak area for the component at each carbon number is calculated with respect to the total area of all the detected peaks and this is taken to be the percentage occurrence (area %) for the individual hydrocarbon compounds. A carbon number distribution chart is constructed plotting the carbon number on the horizontal axis and the percentage occurrence (area %) of the hydrocarbon compounds on the vertical axis.

In the present invention the average carbon number refers to the carbon number for the peak top in the chart for the distribution of the carbon number.

The measurement instrumentation and measurement conditions are as follows.

GC: 6890GC from Hewlett-Packard
column: ULTRA ALLOY-1 P/N: UA1-30m-0.5F (from Frontier Laboratories Ltd.)
carrier gas: He
oven: (1) hold 5 minutes at a temperature of 100° C., (2) ramp up to a temperature of 360° C. at 30° C./minute, (3) hold for 60 minutes at a temperature of 360° C.
injection port: temperature=300° C.
initial pressure: 10.523 psi
split ratio: 50:1
column flow rate: 1 mL/min A second characteristic feature of the polyester resin composition is that ii) the total content of the aliphatic hydrocarbon having an average carbon number of 27 to 50, the structure derived from the long-chain alkyl monoalcohol having an average carbon number of 27 to 50, and the structure derived from the long-chain alkyl monocarboxylic acid having an average carbon number of 27 to 50 is 2.5% by mass or more and 10.0% by mass or less with respect to the mass of the polyester resin composition.

It is difficult to obtain an effect on the low-temperature fixability when the content of structures derived from the long-chain alkyl component is less than 2.5% by mass with respect to the mass of the polyester resin composition. When, on the other hand, 10.0% by mass is exceeded, the plasticizing effect is too strong and the storability is prone to deteriorate. Due to this, the amount of addition of the long-chain alkyl component to the resin must be suitably controlled. This content is preferably from 3.5% by mass to 7.5% by mass.

A third characteristic feature of the polyester resin composition is that in the endothermic quantity obtained by differential scanning calorimetric measurement (DSC), the peak top temperature of an endothermic peak in the polyester resin composition is 60.0° C. or more and 90.0° C. or less (preferably 70° C. or more and 85° C. or less). In addition, the endothermic quantity (ΔH) of this endothermic peak is 0.10 J/g or more and 1.90 J/g or less. ΔH is preferably 0.20 J/g or more and 1.00 J/g or less.

An object of the present invention, as indicated above, is to provide a toner that exhibits an excellent low-temperature fixability and little contamination of members such as the fixing unit and so forth. Due to this, the amount of the free component that is not bonded to the polyester resin component, i.e., the unmodified aliphatic hydrocarbon, must be optimized.

This unmodified aliphatic hydrocarbon exhibits an endothermic peak in the endothermic quantity obtained by differential scanning calorimetric (DSC). As a result, the present inventors discovered that, by optimizing the endothermic quantity (ΔH) of this endothermic peak, a toner can be provided that exhibits an excellent low-temperature fixability and that in addition is able to suppress volatilization of the unmodified aliphatic hydrocarbon during fixing and thus exhibits little contamination of members such as the fixing unit and so forth.

The presence of the endothermic quantity ΔH observed by DSC in the range given in the present application indicates that there is little free long-chain alkyl component, i.e., it is inserted into the polyester resin (main binder).

Contamination of members such as the fixing unit and so forth is suppressed by the efficient insertion of the long-chain alkyl component into the polyester resin. On the other hand, by having the unmodified aliphatic hydrocarbon as indicated by ΔH be a prescribed amount, the plasticizing effect appears rapidly starting from the unmodified form segment. This is also advantageous for the low-temperature fixability in high print speed systems.

As a result, a toner can be provided that exhibits an excellent low-temperature fixability and that in addition is able to suppress volatilization of the unmodified aliphatic hydrocarbon during fixing and thus exhibits little contamination of members such as the fixing unit and so forth.

The peak top temperature and endothermic quantity (ΔH) of the endothermic peak are measured in the present invention by the following method. The peak top temperature and endothermic peak quantity of the endothermic peak by differential scanning calorimetric measurement (DSC) are measured based on ASTM D 3418-82 using a "Q2000" differential scanning calorimeter (TA Instruments). Temperature correction in the instrument detection section is performed using the melting points of indium and zinc, and the amount of heat is corrected using the heat of fusion of indium.

Specifically, approximately 5 mg of the measurement sample is accurately weighed out and this is introduced into an aluminum pan and the measurement is run at normal temperature and normal humidity at a ramp rate of 10° C./minute in the measurement temperature range between 30° C. and 200° C. using an empty aluminum pan as reference. The measurement is carried out by initially raising the temperature to 200° C., then cooling to 30° C., and then reheating. The temperature at the peak top of the maximum endothermic peak in the 30° C. to 200° C. temperature range in the DSC curve (temperature-endothermic quantity curve) obtained in this ramp up process is determined. In addition, the endothermic quantity ΔH of the endothermic peak is the integration value for the endothermic peak.

Methods for controlling the amount of free long-chain alkyl component, i.e., the endothermic peak quantity in DSC, can be exemplified by the method of increasing the alcohol modification rate or acid modification rate of the aliphatic hydrocarbon.

Thus, with regard to the alcohol- or acid-modified long-chain alkyl component, it reacts with the polyester resin during the polymerization reaction and is thereby inserted into the polyester resin and as a result an endothermic peak does not appear for it in DSC measurements. The unmodified aliphatic hydrocarbon component, on the other hand, does not have a site that reacts with the polyester resin and as a consequence is present in a free state in the polyester resin and increases the endothermic quantity in DSC.

As noted above, the long-chain alkyl monoalcohol having an average of 27 to 50 carbons and the long-chain alkyl monocarboxylic acid having an average of 27 to 50 carbons that are used in the present invention are obtained industrially by the alcohol- or acid-modification of a starting aliphatic hydrocarbon.

This aliphatic hydrocarbon encompasses saturated hydrocarbons and unsaturated hydrocarbons and can be exemplified by alkanes, alkenes, and alkynes and by cyclic hydrocarbons such as cyclohexane, but saturated hydrocarbons (alkanes) are preferred.

For example, for the alcohol-modified product, it is known that an aliphatic hydrocarbon having 27 to 50 carbons can be converted to the alcohol by liquid-phase oxidation with a molecular oxygen-containing gas in the presence of a catalyst such as boric acid, boric anhydride, or metaboric acid. The amount of addition for the catalyst used is preferably from 0.01 to 0.5 mol per 1 mol of the starting saturated hydrocarbon.

A broad range of molecular oxygen-containing gases can be used for the molecular oxygen-containing gas that is injected into the reaction system, for example, oxygen, air, or these diluted with an inert gas; however, an oxygen concentration of from 3 to 20% is preferred. The reaction temperature is preferably from 100° C. to 200° C.

In order to satisfy the stipulation of the endothermic quantity by DSC in accordance with the present invention, control into the range of the present application can be effected by optimization of the reaction conditions and by the removal of the unmodified aliphatic hydrocarbon component by carrying out a purification step after the modification reaction.

In order to effect control into the range of the present invention for the endothermic quantity by DSC, the preferred range for the modification rate of the aliphatic hydrocarbon component is at least 85% and is more preferably at least 90%. The upper limit, on the other hand, is preferably 99% or less.

Thus, for the alcohol component-containing composition (A), the content ratio of the long-chain alkyl monoalcohol is preferably at least 85% and more preferably at least 90% with respect to the total amount of the long-chain alkyl monoalcohol and the aliphatic hydrocarbon. For the composition (C), the content ratio of the long-chain alkyl monoalcohol is, as for the composition (A), also preferably at least 85% and more preferably at least 90% with respect to the total amount of the long-chain alkyl monoalcohol and the aliphatic hydrocarbon.

For the acid-component containing composition (B), on the other hand, the content ratio of the long-chain alkyl monocarboxylic acid is preferably at least 85% and more preferably at least 90% with respect to the total amount of the long-chain alkyl monocarboxylic acid and the aliphatic hydrocarbon. For the composition (D), the content ratio of the long-chain alkyl monocarboxylic acid is, as for the composition (B), also preferably at least 85% and more preferably at least 90% with respect to the total amount of the long-chain alkyl monocarboxylic acid and the aliphatic hydrocarbon.

The average value of the carbon number in the long-chain alkyl component used in the present invention is preferably from 30 to 40, and its melting point (temperature of an endothermic peak in DSC) is preferably from 70° C. to 80° C.

The long-chain alkyl monoalcohol in the present invention preferably contains secondary alcohol as its major component. The presence of secondary alcohol as the major component means that at least 50% by mass of the long-chain alkyl monoalcohol is secondary alcohol.

The use of secondary alcohol as the major component of the long-chain alkyl monoalcohol facilitates the assumption of a folded structure by the long-chain alkyl component. This is preferred because, as a result, steric hindrance is inhibited and a more uniform occurrence of the long-chain alkyl component in the polyester resin composition is facilitated and the storage stability is further improved. In addition, when a long-chain alkyl monoalcohol is used for the long-chain alkyl component of the present invention, its hydroxyl value is preferably from 80 mg KOH/g to 140 mg KOH/g and is more preferably from 90 mg KOH/g to 130 mg KOH/g.

A preferred acid value when a long-chain alkyl monocarboxylic acid is used is from 80 mg KOH/g to 150 mg KOH/g, while from 90 mg KOH/g to 140 mg KOH/g is more preferred.

Control into these ranges is preferred because the reactivity between the polyester resin component and the modified segment is thereby raised and as a result the peak area (ΔH) in DSC can be efficiently lowered.

Measurement of the acid value and hydroxyl value of the long-chain alkyl monomer in the present invention (long-chain alkyl monoalcohol, long-chain alkyl monocarboxylic acid) can be carried out as follows.

<Method for Measuring the Hydroxyl Value of the Long-Chain Alkyl Monomer>

(Instrumentation and equipment)

graduated cylinder (100 mL)

one-mark pipette (5 mL)

flat-bottom flask (200 mL)

glycerol bath (Reagents)

acetylation reagent (Introduce 25 g acetic anhydride into a 100 mL volumetric flask; bring the volume to 100 mL by the addition of pyridine; and mix thoroughly by shaking.)

phenolphthalein solution 0.5 kmol/$m^3$ ethanolic potassium hydroxide solution (Measurement Procedure)

(a) Exactly weigh 0.5 to 6.0 g of the long-chain alkyl monomer into the flat-bottom flask and add 5 mL of the acetylation reagent to this using the one-mark pipette.

(b) Place a small funnel in the mouth of the flask and heat by immersing the bottom about 1 cm in the glycerol bath brought to a temperature of 95 to 100° C. In order to prevent the temperature from rising due to the effect of the heat from the glycerol bath on the neck of the flask, mount a circular disk of thick paper with a round hole at the center at the base of the neck of the flask.

(c) Remove the flask from the glycerol bath after 1 hour and after cooling add 1 mL water through the funnel and shake to decompose the acetic anhydride.

(d) In order to achieve complete decomposition, reheat the flask on the glycerol bath for an additional 10 minutes, and after cooling rinse the walls of the funnel and flask with 5 mL ethanol (95 vol %).

(e) Add several drops of the phenolphthalein solution as the indicator and titrate with the 0.5 kmol/$m^3$ ethanolic potassium hydroxide solution; the endpoint is when the faint pink color of the indicator persists for approximately 30 seconds.

(f) For the blank test, carry out (a) to (e) without the addition of the long-chain alkyl monomer in (a).

(g) When the sample is difficult to dissolve, carry out dissolution by making a supplemental addition of a small amount of pyridine or by adding xylene or toluene.

(Calculations)

The hydroxyl value of the long-chain alkyl monomer is determined from the obtained results using the following formula (1).

$$A=[\{(B-C)\times 28.05\times f\}/S]+D \quad (1)$$

where:

A: hydroxyl value of the long-chain alkyl monomer (mg KOH/g)

B: amount of 0.5 kmol/$m^3$ ethanolic potassium hydroxide solution used in the blank test (mL)

C: amount of 0.5 kmol/$m^3$ ethanolic potassium hydroxide solution used in titration (mL)

f: factor for the 0.5 kmol/$m^3$ ethanolic potassium hydroxide solution

S: mass of the long-chain alkyl monomer (g)

D: acid value of the long-chain alkyl monomer (mg KOH/g)

28.05: ½×the 56.11 molecular weight of potassium hydroxide

<Method for Measuring the Acid Value of the Long-Chain Alkyl Monomer>

(Instrumentation and Equipment)

Erlenmeyer flask (300 mL)

burette (25 mL)

water bath or hot plate (Reagents)

0.1 kmol/$m^3$ hydrochloric acid 0.1 kmol/$m^3$ ethanolic potassium hydroxide solution (Standardization: Place 25 mL of the 0.1 kmol/$m^3$ hydrochloric acid in the Erlenmeyer flask using a one-mark pipette; add the phenolphthalein solution; titrate with the 0.1 kmol/$m^3$ ethanolic potassium hydroxide solution; determine the factor from the amount required for neutralization.)

phenolphthalein solution solvent (Prepare by mixing diethyl ether and ethanol (99.5 vol %) at a volumetric ratio of 1:1 or 2:1. Add several drops of the phenolphthalein solution as the indicator immediately prior to use and neutralize this with the 0.1 kmol/$m^3$ ethanolic potassium hydroxide solution.)

(Measurement Procedure)

(a) Exactly weigh 1 to 20 g of the long-chain alkyl monomer into the Erlenmeyer flask.

(b) Add 100 mL of the solvent and several drops of the phenolphthalein solution as the indicator and thoroughly shake and mix on the water bath until the long-chain alkyl monomer is completely dissolved.

(c) Titrate with the 0.1 kmol/$m^3$ ethanolic potassium hydroxide solution; the endpoint is when the faint pink color of the indicator persists for approximately 30 seconds.

(Calculations)

The acid value of the long-chain alkyl monomer is determined from the obtained results using the following formula (2).

$$A=5.611\times B\times f/S \quad (2)$$

where:

A: acid value of the long-chain alkyl monomer (mg KOH/g)

B: amount of 0.1 kmol/$m^3$ ethanolic potassium hydroxide solution used in the titration (mL)

f: factor for the 0.1 kmol/$m^3$ ethanolic potassium hydroxide solution

S: mass of the long-chain alkyl monomer (g)

5.611: 1/10×the 56.11 molecular weight of potassium hydroxide

There are no particular limitations on the method of producing the polyester resin composition according to the present invention, but the following production methods are preferred.

Thus, the polyester resin composition used by the present invention is preferably the reaction product obtained by reacting an alcohol component-containing composition (A) and an acid component-containing composition (B). This composition (A) and composition (B) preferably satisfy at least one of the following conditions i) and ii):

i) the alcohol component contains long-chain alkyl monoalcohol having an average of 27 to 50 carbons and the composition (A) contains aliphatic hydrocarbon having an average of 27 to 50 carbons, and ii) the acid component contains long-chain alkyl monocarboxylic acid having an average of 27 to 50 carbons and the composition (B) contains aliphatic hydrocarbon having an average of 27 to 50 carbons.

The polyester resin composition is also preferably the reaction product of a composition (C) and a polyester resin having the carboxyl group in terminal position. The composition (C) contains long-chain alkyl monoalcohol having an average of 27 to 50 carbons and aliphatic hydrocarbon having an average of 27 to 50 carbons. This reaction product is a polyester resin composition obtained by a method that includes a step of reacting the long-chain alkyl monoalcohol with the carboxyl groups present on the polyester resin.

The polyester resin composition is also preferably the reaction product of a composition (D) and a polyester resin having the hydroxyl group in terminal position. The composition (D) contains long-chain alkyl monocarboxylic acid having an average of 27 to 50 carbons and aliphatic hydrocarbon having an average of 27 to 50 carbons. This reaction product is a polyester resin composition obtained by a method that includes a step of reacting the long-chain alkyl monocarboxylic acid with the hydroxyl groups present on the polyester resin.

More preferred is a polyester resin composition (reaction product) obtained by reacting the alcohol component-containing composition (A) and the acid component-containing composition (B) wherein the alcohol component contains long-chain alkyl monoalcohol having an average of 27 to 50 carbons and the composition (A) contains aliphatic hydrocarbon having an average of 27 to 50 carbons. That is, the polyester resin composition is preferably obtained by carrying out the polymerization reaction that yields the polyester in the presence of long-chain alkyl monoalcohol and the aliphatic hydrocarbon component that is the unmodified component.

A more consistent increase in the modification rate is readily achieved by using a long-chain alkyl monoalcohol as the long-chain alkyl component. Moreover, the long-chain alkyl component can be efficiently and uniformly inserted into the resin by introducing the long-chain alkyl component from the start of the polyester synthesis reaction, which is thus preferred.

The polyester resin composition of the present invention is also preferably a hybrid resin composition containing a hybrid resin in which a polyester segment is chemically bonded to a vinyl polymer segment.

The use of a hybrid resin is preferred because this provides a stable charging performance regardless of the environment and enhances the stability of the image density in a high-humidity environment.

In this case, the long-chain alkyl component is preferably condensed in terminal position on the polyester segment of the hybrid resin.

The mass ratio between the polyester segment and the vinyl polymer segment (polyester segment/vinyl polymer segment) in this hybrid resin is preferably 50/50 to 90/10 and is more preferably 60/40 to 80/20.

This range is preferred because it facilitates obtaining a stable low-temperature fixability regardless of the environment, while also providing the advantages of the hybrid resin.

The following compounds are examples of the polyester-forming monomer for the polyester resin used in the polyester resin composition according to the present invention or for the polyester segment of the aforementioned hybrid resin.

The alcohol component can be exemplified by the following: ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, hydrogenated bisphenol A, bisphenol derivatives given by the following formula (3), and diols given by the following formula (4)

(3)

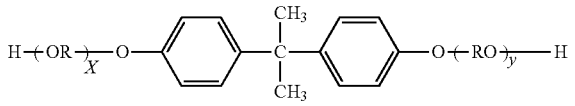

(in the formula, R is an ethylene or propylene group; x and y are each integers equal to or greater than 1; and the average value of x+y is 2 to 10)

(4)

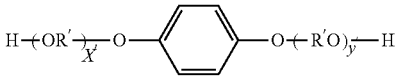

(in the formula, R' is

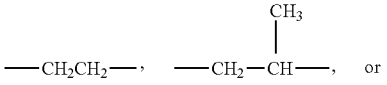

-continued

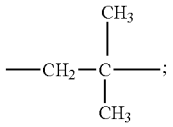

x' and y' are each integers equal to or greater than 1; and the average value of x'+y' is 2 to 10).

When a bisphenol derivative with formula (3) is used, the ratio EO:PO between the ethylene oxide (EO) adduct and the propylene oxide (PO) adduct is preferably 40:60 to 60:40. Controlling the EO:PO ratio into this range supports a more uniform dispersion of the long-chain alkyl component in the resin and provides an excellent storage stability and is therefore preferred.

The acid component can be exemplified by the following: benzenedicarboxylic acids and their anhydrides, such as phthalic acid, terephthalic acid, isophthalic acid, and phthalic anhydride; alkyl dicarboxylic acids such as succinic acid, adipic acid, sebacic acid, and azelaic acid, and their anhydrides; succinic acid substituted by a $C_{6-18}$ alkyl group or alkenyl group, and the anhydride thereof; and unsaturated dicarboxylic acids such as fumaric acid, maleic acid, citraconic acid, and itaconic acid, and their anhydrides.

An at least tribasic polybasic carboxylic acid or anhydride thereof and/or an at least trihydric polyhydric alcohol may be used for the polyester resin used in the polyester resin composition according to the present invention or for the polyester segment of the aforementioned hybrid resin. The at least tribasic polybasic carboxylic acids and anhydrides thereof can be exemplified by the following: 1,2,4-benzenetricarboxylic acid, 1,2,4-cyclohexanetricarboxylic acid, 1,2,4-naphthalenetricarboxylic acid, and pyromellitic acid and their anhydrides and lower alkyl esters. The at least trihydric polyhydric alcohols can be exemplified by 1,2,3-propanetriol, trimethylolpropane, hexanetriol, and pentaerythritol. Aromatic carboxylic acids, which are also very stable to environmental fluctuations, are particularly preferred for the polyester resin composition of the present invention, and an example here is 1,2,4-benzenetricarboxylic acid and its anhydride.

The following compounds are examples of the vinylic monomer for forming the vinyl polymer segment of the hybrid resin when the aforementioned hybrid resin is used in the polyester resin composition according to the present invention:

styrene and its derivatives such as styrene, o-methylstyrene, m-methylstyrene, p-methylstyrene, p-methoxystyrene, p-phenylstyrene, p-chlorostyrene, 3,4-dichlorostyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, and p-n-dodecylstyrene; ethylenically unsaturated monoolefins such as ethylene, propylene, butylene, and isobutylene; unsaturated polyenes such as butadiene and isoprene; vinyl halides such as vinyl chloride, vinylidene chloride, vinyl bromide, and vinyl fluoride; vinyl esters such as vinyl acetate, vinyl propionate, and vinyl benzoate; α-methylene aliphatic monocarboxylic acid esters such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, and diethylaminoethyl methacrylate; acrylate esters such as methyl acrylate, ethyl acrylate, n-butyl acrylate, isobutyl acrylate, propyl acrylate, n-octyl acrylate, dodecyl acrylate, 2-ethylhexyl acrylate, stearyl acrylate, 2-chloroethyl acrylate, and phenyl acrylate; vinyl ethers such as vinyl methyl ether, vinyl ethyl ether, and vinyl isobutyl ether; vinyl ketones such as vinyl methyl ketone, vinyl hexyl ketone, and methyl isopropenyl ketone; N-vinyl compounds such as N-vinylpyrrole, N-vinylcarbazole, N-vinylindole, and N-vinylpyrrolidone; vinylnaphthalene; and derivatives of acrylic acid or methacrylic acid such as acrylonitrile, methacrylonitrile, and acrylamide.

The following are additional examples: unsaturated dibasic acids such as maleic acid, citraconic acid, itaconic acid, alkenylsuccinic acid, fumaric acid, and mesaconic acid; unsaturated dibasic acid anhydrides such as maleic anhydride, citraconic anhydride, itaconic anhydride, and alkenylsuccinic anhydride; the half esters of unsaturated dibasic acids, such as the methyl half ester of maleic acid, ethyl half ester of maleic acid, butyl half ester of maleic acid, methyl half ester of citraconic acid, ethyl half ester of citraconic acid, butyl half ester of citraconic acid, methyl half ester of itaconic acid, methyl half ester of alkenylsuccinic acid, methyl half ester of fumaric acid, and methyl half ester of mesaconic acid; esters of unsaturated dibasic acids, such as dimethyl maleate and dimethyl fumarate; α,β-unsaturated acids such as acrylic acid, methacrylic acid, crotonic acid, and cinnamic acid; the anhydrides of α,β-unsaturated acids, such as crotonic anhydride and cinnamic anhydride; anhydrides between an α,β-unsaturated acid and a lower fatty acid; and carboxyl group-containing monomers such as alkenylmalonic acid, alkenylglutaric acid, and alkenyladipic acid and their anhydrides and monoesters.

Additional examples are esters of acrylic acid or methacrylic acid, such as 2-hydroxyethyl acrylate, 2-hydroxyethyl methacrylate, and 2-hydroxypropyl methacrylate, and hydroxy group-containing monomers such as 4-(1-hydroxy-1-methylbutyl)styrene and 4-(1-hydroxy-1-methylhexyl) styrene.

When this hybrid resin is used in the polyester resin composition according to the present invention, the vinyl polymer segment of the hybrid resin may have a crosslinked structure provided by crosslinking through a crosslinking agent having two or more vinyl groups. The crosslinking agent used in this case can be exemplified by the following:

aromatic divinyl compounds (divinylbenzene, divinylnaphthalene), diacrylate compounds in which linkage is through an alkyl chain (ethylene glycol diacrylate, 1,3-butylene glycol diacrylate, 1,4-butanediol diacrylate, 1,5-pentanediol diacrylate, 1,6-hexanediol diacrylate, neopentyl glycol diacrylate, and compounds provided by changing the acrylate in these compounds to methacrylate), diacrylate compounds in which linkage is through an alkyl chain that contains the ether bond (for example, diethylene glycol diacrylate, triethylene glycol diacrylate, tetraethylene glycol diacrylate, polyethylene glycol #400 diacrylate, polyethylene glycol #600 diacrylate, dipropylene glycol diacrylate, and compounds provided by changing the acrylate in these compounds to methacrylate), diacrylate compounds in which linkage is through an aromatic group and a chain containing the ether bond [polyoxyethylene(2)-2,2-bis(4-hydroxyphenyl)propane diacrylate and polyoxyethylene(4)-2,2-bis(4-hydroxyphenyl)propane diacrylate and compounds provided by changing the acrylate in these compounds to methacrylate], and polyester-type diacrylate compounds ("MANDA" from Nippon Kayaku Co., Ltd.).

Polyfunctional crosslinking agents (having three or more vinyl groups) can be exemplified by the following: pentaerythritol triacrylate, trimethylolethane triacrylate, trimethylolpropane triacrylate, tetramethylolmethane tetraacrylate, oligoester acrylate, compounds provided by changing the acrylate in these compounds to methacrylate, triallyl cyanurate, and triallyl trimellitate.

This crosslinker is used, per 100 mass parts of the other monomer components, preferably at from 0.01 mass parts to 10.00 mass parts and more preferably at from 0.03 mass parts to 5.00 mass parts.

Among these crosslinking agents, the aromatic divinyl compounds (particularly divinylbenzene) and diacrylate compounds in which linkage is through an aromatic group and a chain containing the ether bond are examples of crosslinking agents that are favorably used in the polyester resin composition from the standpoint of the fixing performance and offset resistance.

The following are examples of the polymerization initiator used in the polymerization of the vinyl resin or vinyl polymer segment: 2,2'-azobisisobutyronitrile, 2,2'-azobis(4-methoxy-2,4-dimethylvaleronitrile), 2,2'-azobis(2,4-dimethylvaleronitrile), 2,2'-azobis(2-methylbutyronitrile), dimethyl 2,2'-azobisisobutyrate, 1,1'-azobis(1-cyclohexanecarbonitrile), 2-(carbamoylazo)isobutyronitrile, 2,2'-azobis(2,4,4-trimethylpentane), 2-phenylazo-2,4-dimethyl-4-methoxyvaleronitrile, 2,2'-azobis(2-methylpropane), ketone peroxides (e.g., methyl ethyl ketone peroxide, acetylacetone peroxide, cyclohexanone peroxide), 2,2-bis(tert-butylperoxy)butane, tert-butyl hydroperoxide, cumene hydroperoxide, 1,1,3,3-tetramethylbutyl hydroperoxide, di-tert-butyl peroxide, tert-butyl cumyl peroxide, dicumyl peroxide, α,α'-bis(tert-butylperoxyisopropyl) benzene, isobutyl peroxide, octanoyl peroxide, decanoyl peroxide, lauroyl peroxide, 3,5,5-trimethylhexanoyl peroxide, benzoyl peroxide, m-toluoyl peroxide, diisopropyl peroxydicarbonate, di-2-ethylhexyl peroxydicarbonate, di-n-propyl peroxydicarbonate, di-2-ethoxyethyl peroxycarbonate, dimethoxyisopropyl peroxydicarbonate, di(3-methyl-3-methoxybutyl) peroxycarbonate, acetylcyclohexylsulfonyl peroxide, tert-butyl peroxyacetate, tert-butyl peroxyisobutyrate, tert-butyl peroxyneodecanoate, tert-butyl peroxy-2-ethylhexanoate, tert-butyl peroxylaurate, tert-butyl peroxybenzoate, tert-butylperoxy isopropyl carbonate, di-tert-butyl peroxyisophthalate, tert-butylperoxy allyl carbonate, tert-amylperoxy 2-ethylhexanoate, di-tert-butylperoxy hexahydroterephthalate, and di-tert-butylperoxy azelate.

When the aforementioned hybrid resin is used in the polyester resin composition in the present invention, a monomer component capable of reacting with both resin components (a dual reactive monomer) is preferably contained in the vinyl resin and/or polyester resin component. Among monomers that can constitute the polyester resin component, monomers capable of reacting with the vinyl resin can be exemplified by unsaturated dicarboxylic acids, e.g., fumaric acid, maleic acid, citraconic acid, and itaconic acid, and their anhydrides. Among monomers that can constitute the vinyl resin component, monomers capable of reacting with the polyester resin component can be exemplified by monomers containing the carboxyl group or hydroxy group and also by acrylic acid, methacrylic acid, and their esters.

In a preferred method for obtaining the reaction product of the vinyl resin and polyester resin, the polymerization reaction of either or both resins is brought about with a polymer that contains a dual reactive monomer being present.

When considering the monomer content in the hybrid resin, this dual reactive monomer is regarded as monomer that will constitute the polyester segment. The reason for this is as follows: the dual reactive monomer exercises a greater influence on the properties of the condensation polymerization-based resin (the polyester segment) regardless of whether the condensation polymerization reaction or the addition polymerization reaction has been previously carried out.

A single polyester resin composition as described in the preceding may be used, but a mixture in any range of two species having different softening points, i.e., a higher softening point resin (H) and a lower softening point resin (L), may also be used. The higher softening point resin (H) preferably has a softening point of from 100° C. to 170° C. The lower softening point resin (L) preferably has a softening point of at least 70° C. to less than 100° C.

When two different resins are used, preferably at least 50% by mass in the resin is the polyester resin composition of the present invention.

When a single species of the polyester resin composition is used by itself, the softening point Tm is preferably from 90° C. to 170° C. and is more preferably from 100° C. to 130° C. An excellent balance between the hot offset resistance and low-temperature fixability is provided when Tm is in the indicated range.

The softening point of the polyester resin composition is measured according to the manual provided with the instrument, using a constant-load extrusion-type capillary rheometer, i.e., the "Flowtester CFT-500D Flow Property Evaluation Instrument" (from Shimadzu Corporation). With this instrument, while a constant load is applied by a piston from the top of the measurement sample, the measurement sample filled in a cylinder is heated and melted and the melted measurement sample is extruded from a die at the bottom of the cylinder; a flow curve showing the relationship between piston stroke and temperature is obtained from this.

The "melting temperature by the ½ method", as described in the manual provided with the "Flowtester CFT-500D Flow Property Evaluation Instrument", is used as the softening point in the present invention. The melting temperature by the ½ method is determined as follows. First, ½ of the difference between Smax, which is the piston stroke at the completion of outflow, and Smin, which is the piston stroke at the start of outflow, is determined (this is designated as X where X=(Smax−Smin)/2). The temperature of the flow curve when the piston stroke in the flow curve reaches the sum of X and Smin is the melting temperature Tm by the ½ method.

The measurement specimen used is prepared by subjecting approximately 1.0 g of the sample to compression molding for approximately 60 seconds at approximately 10 MPa in a 25° C. environment using a tablet compression molder (for example, NT-100H, from NPa System Co., Ltd.) to provide a cylindrical shape with a diameter of approximately 8 mm.

The measurement conditions with the CFT-500D are as follows.

test mode: rising temperature method
start temperature: 50° C.
saturated temperature: 200° C.
measurement interval: 1.0° C.
ramp rate: 4.0° C./min
piston cross section area: 1.000 $cm^2$
test load (piston load): 10.0 kgf (0.9807 MPa)
preheating time: 300 seconds
diameter of die orifice: 1.0 mm
die length: 1.0 mm In addition, the glass transition temperature (Tg) of the polyester resin composition is preferably at least 45.0° C. viewed in terms of the storage stability, while at least 50.0° C. is more preferred. Viewed from the perspective of the low-temperature fixability, Tg is preferably not more than 75.0° C. and is more preferably not more than 65.0° C. The glass transition temperature (Tg) of the polyester resin composition for toner use is measured based on ASTM D 3418-82 using a "Q2000" differential scanning calorimeter (TA Instruments).

Approximately 3 mg of the polyester resin composition is accurately weighed out and is used as the measurement sample. This is introduced into an aluminum pan and an empty aluminum pan is used as reference. Using a measurement temperature range of 30° C. to 200° C., the temperature is initially raised from 30° C. to 200° C. at a ramp rate of 10° C./minute, followed by cooling from 200° C. to 30° C. at a ramp down rate of 10° C./min and then reheating to 200° C. at a ramp rate of 10° C./min. Using the DSC curve obtained in the second heating process, the glass transition temperature Tg of the resin is taken to be the intersection between the differential heat curve and the line for the midpoint between the baseline prior to the appearance of the specific heat change and the baseline after the appearance of the specific heat change.

The acid value of the polyester resin composition of the present invention is preferably from 15.0 mg KOH/g to 30.0 mg KOH/g and is more preferably from 20.0 mg KOH/g to 30.0 mg KOH/g.

Controlling the acid value into the indicated range is preferred because this suppresses the appearance of the reduced charging caused by standing in a high-humidity environment. The acid value of the polyester resin composition can be controlled through the monomer composition and the molecular weight.

The acid value is the number of milligrams of potassium hydroxide required to neutralize the acid present in 1 g of a sample. The acid value of the polyester resin composition is measured in accordance with JIS K 0070-1992, and in specific terms is measured according to the following procedure.

(1) Reagent Preparation

A phenolphthalein solution is obtained by dissolving 1.0 g of phenolphthalein in 90 mL of ethyl alcohol (95 vol %) and bringing to 100 mL by adding deionized water.

7 g of special-grade potassium hydroxide is dissolved in 5 mL of water and this is brought to 1 L by the addition of ethyl alcohol (95 vol %). This is introduced into an alkali-resistant container avoiding contact with, for example, carbon dioxide, and allowed to stand for 3 days, followed by filtration to obtain a potassium hydroxide solution. The obtained potassium hydroxide solution is stored in an alkali-resistant container. The factor for this potassium hydroxide solution is determined from the amount of the potassium hydroxide solution required for neutralization when 25 mL of 0.1 mol/L hydrochloric acid is introduced into an Erlenmeyer flask, several drops of the aforementioned phenolphthalein solution is added, and titration is performed using the potassium hydroxide solution. The 0.1 mol/L hydrochloric acid is prepared in accordance with JIS K 8001-1998.

(2) Procedure (A) Main Test 2.0 g of a sample of the pulverized polyester resin composition is exactly weighed into a 200-mL Erlenmeyer flask and 100 mL of a toluene/ethanol (2:1) mixed solution is added and dissolution of the sample is carried out over 5 hours. Several drops of the aforementioned phenolphthalein solution are then added as an indicator and titration is performed using the aforementioned potassium hydroxide solution. The titration endpoint is taken to be persistence of the faint pink color of the indicator for about 30 seconds.

(B) Blank Test

The same titration as in the above procedure is run, but without using the sample (that is, with only the toluene/ethanol (2:1) mixed solution).

(3) The obtained results are substituted into the following formula to calculate the acid value.

$$A=[(C-B)\times f\times 5.61]/S$$

Here, A: acid value (mg KOH/g); B: amount (mL) of addition of the potassium hydroxide solution in the blank test; C: amount (mL) of addition of the potassium hydroxide solution in the main test; f: factor for the potassium hydroxide solution; and S: sample (g).

There are no particular limitations in the present invention on the method of producing the toner particle, and a known production method may be used. An example is the so-called pulverization method, in which the toner particle is obtained through a melt-kneading step, in which the toner constituent materials, i.e., a resin component containing the polyester resin composition, and as necessary a colorant, release agent, charge control agent, and so forth, are mixed to uniformity and then melt-kneaded, and a pulverization step, in which the obtained melt-kneaded material is cooled and is subsequently pulverized using a pulverizer, e.g., a mechanical pulverizer.

With regard to other methods, the toner particle may also be produced by a so-called polymerization method, e.g., an emulsion polymerization method, a suspension polymerization method, and so forth.

Among the preceding, the toner particle of the present invention is preferably a toner particle obtained by at least a melt-kneading step and a pulverization step.

The melt-kneading apparatus can be exemplified by twin-screw kneading extruders, hot rolls, kneaders, and extruders.

The temperature in the melt-kneading is preferably controlled such that the temperature of the kneaded material is from 70° C. to 200° C. Control into the indicated temperature range supports an excellent dispersibility for the polyester resin.

The method of producing the toner particle through at least a melt-kneading step and a pulverization step is specifically described in the following, but there is no limitation to this.

A resin component containing the polyester resin composition, and as necessary a colorant, release agent, charge control agent, other additives, and so forth, are thoroughly mixed with a mixer such as a Henschel mixer or ball mill (mixing step). The resulting mixture is melt-kneaded using a heated kneader such as a twin-screw kneading extruder, hot roll, kneader, or extruder (melt-kneading step). A release agent, magnetic oxide particles, and a metal-containing compound may also be added here. After cooling and solidification of the melt-kneaded material, pulverization (pulverization step) and classification (classification step) are carried out to obtain the toner particle. As necessary, the toner particle may be additionally mixed with an external additive using a mixer such as a Henschel mixer to obtain a toner.

The mixer can be exemplified by the following: the Henschel mixer (Nippon Coke & Engineering Co., Ltd.); Supermixer (Kawata Mfg. Co., Ltd.); Ribocone (Okawara Corporation); Nauta mixer, Turbulizer, and Cyclomix (Hosokawa Micron Corporation); Spiral Pin Mixer (Pacific Machinery & Engineering Co., Ltd.); and Loedige Mixer (Matsubo Corporation).

The kneading apparatus can be exemplified by the following: the KRC Kneader (Kurimoto, Ltd.); Buss Ko-Kneader (Buss Corp.); TEM extruder (Toshiba Machine Co., Ltd.); TEX twin-screw kneader (The Japan Steel Works, Ltd.); PCM Kneader (Ikegai Ironworks Corporation); three-roll mills, mixing roll mills, and kneaders (Inoue Manufacturing Co., Ltd.); Kneadex (Mitsui Mining Co., Ltd.); model MS pressure kneader and Kneader-Ruder (Moriyama Mfg. Co., Ltd.); and Banbury mixer (Kobe Steel, Ltd.).

The pulverizer can be exemplified by the following: Counter Jet Mill, Micron Jet, and Inomizer (Hosokawa Micron Corporation); IDS mill and PJM Jet Mill (Nippon Pneumatic Mfg. Co., Ltd.); Cross Jet Mill (Kurimoto, Ltd.); Ulmax (Nisso Engineering Co., Ltd.); SK Jet-O-Mill (Seishin Enterprise Co., Ltd.); Kryptron (Kawasaki Heavy Industries, Ltd.); Turbo Mill (Turbo Kogyo Co., Ltd.); and Super Rotor (Nisshin Engineering Inc.).

The classifier can be exemplified by the following: Classiel, Micron Classifier, and Spedic Classifier (Seishin Enterprise Co., Ltd.); Turbo Classifier (Nisshin Engineering Inc.); Micron Separator, Turboplex (ATP), and TSP Separator (Hosokawa Micron Corporation); Elbow Jet (Nittetsu Mining Co., Ltd.); Dispersion Separator (Nippon Pneumatic Mfg. Co., Ltd.); and YM Microcut (Yasukawa Shoji Co., Ltd.).

Screening devices that can be used to screen out the coarse particles can be exemplified by the following: Ultrasonic (Koei Sangyo Co., Ltd.), Rezona Sieve and Gyro-Sifter (Tokuju Corporation), Vibrasonic System (Dalton Co., Ltd.), Soniclean (Sintokogio, Ltd.), Turbo Screener (Turbo Kogyo Co., Ltd.), Microsifter (Makino Mfg. Co., Ltd.), and circular vibrating sieves.

The toner of the present invention may be used as any of the following toners: magnetic single-component toners, nonmagnetic single-component toners, and nonmagnetic two-component toners.

When used as a magnetic single-component toner, magnetic iron oxide particles are preferably used as the colorant. The magnetic iron oxide particles incorporated in a magnetic single-component toner can be exemplified by magnetic iron oxides such as magnetite, maghemite, and ferrite and magnetic iron oxides that contain other metal oxides, and by metals such as Fe, Co, and Ni and alloys of these metals with metals such as Al, Co, Cu, Pb, Mg, Ni, Sn, Zn, Sb, Be, Bi, Cd, Ca, Mn, Se, Ti, W, and V, and their mixtures.

The magnetic iron oxide particle used in the toner of the present invention preferably has an octahedral shape. The octahedral shape provides an excellent dispersibility for the magnetic iron oxide particle.

The amount of addition of the magnetic iron oxide particle is preferably from 25% by mass to 50% by mass in the toner and is more preferably from 30% by mass to 45% by mass.

On the other hand, the colorant in the case of use as a nonmagnetic single-component toner or nonmagnetic two-component toner can be exemplified by the following.

Carbon blacks such as furnace black, channel black, acetylene black, thermal black, and lamp black may be used as a black pigment, as can a magnetic powder such as magnetite or ferrite.

A pigment or dye can be used as a suitable colorant for yellow. The pigments can be exemplified by C. I. Pigment Yellow 1, 2, 3, 4, 5, 6, 7, 10, 11, 12, 13, 14, 15, 17, 23, 62, 65, 73, 74, 81, 83, 93, 94, 95, 97, 98, 109, 110, 111, 117, 120, 127, 128, 129, 137, 138, 139, 147, 151, 154, 155, 167, 168, 173, 174, 176, 180, 181, 183, and 191 and by C. I. Vat Yellow 1, 3, and 20. The dyes can be exemplified by C. I.

Solvent Yellow 19, 44, 77, 79, 81, 82, 93, 98, 103, 104, 112, and 162. A single one of these may be used by itself or two or more may be used in combination.

A pigment or dye can be used as a suitable colorant for cyan. The pigments can be exemplified by C. I. Pigment Blue 1, 7, 15, 15;1, 15;2, 15;3, 15;4, 16, 17, 60, 62, and 66 and by C. I. Vat Blue 6 and C. I. Acid Blue 45. The dyes can be exemplified by C. I. Solvent Blue 25, 36, 60, 70, 93, and 95. A single one of these may be used by itself or two or more may be used in combination.

A pigment or dye can be used as a suitable colorant for magenta. The pigments can be exemplified by C. I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 48;2, 48;3, 48;4, 49, 50, 51, 52, 53, 54, 55, 57, 57;1, 58, 60, 63, 64, 68, 81, 81;1, 83, 87, 88, 89, 90, 112, 114, 122, 123, 144, 146, 150, 163, 166, 169, 177, 184, 185, 202, 206, 207, 209, 220, 221, 238, and 254; C. I. Pigment Violet 19; and C. I. Vat Red 1, 2, 10, 13, 15, 23, 29, and 35. The magenta dyes can be exemplified by oil-soluble dyes such as C. I. Solvent Red 1, 3, 8, 23, 24, 25, 27, 30, 49, 52, 58, 63, 81, 82, 83, 84, 100, 109, 111, 121, and 122, C. I. Disperse Red 9, C. I. Solvent Violet 8, 13, 14, 21, and 27, and C. I. Disperse Violet 1; and by basic dyes such as C. I. Basic Red 1, 2, 9, 12, 13, 14, 15, 17, 18, 22, 23, 24, 27, 29, 32, 34, 35, 36, 37, 38, 39, and 40, and C. I. Basic Violet 1, 3, 7, 10, 14, 15, 21, 25, 26, 27, and 28. A single one of these may be used itself or two or more may be used in combination.

The amount of colorant addition, expressed per 100.0 mass parts of the resin component that contains the polyester resin composition, is preferably from 0.1 mass parts to 60.0 mass parts and more preferably from 0.5 mass parts to 50.0 mass parts.

A release agent (wax) may be used on an optional basis in the toner of the present invention in order to impart releasability to the toner. Viewed in terms of the ease of dispersion in the toner and the magnitude of the releasability, a hydrocarbon wax, such as low molecular weight polyethylene, low molecular weight polypropylene, microcrystalline wax, or paraffin wax, is preferably used as the wax. As necessary, one or two or more waxes may also be co-used in a minor amount. The following are examples:

oxides of aliphatic hydrocarbon waxes, such as oxidized polyethylene wax, and their block copolymers; waxes in which the major component is fatty acid ester, such as carnauba wax, sasol wax, and montanic acid ester waxes; and waxes provided by the partial or complete deacidification of fatty acid esters, such as deacidified carnauba wax. Additional examples are as follows: saturated straight-chain fatty acids such as palmitic acid, stearic acid, and montanic acid; unsaturated fatty acids such as brassidic acid, eleostearic acid, and parinaric acid; saturated alcohols such as stearyl alcohol, aralkyl alcohols, behenyl alcohol, carnaubyl alcohol, ceryl alcohol, and melissyl alcohol; long-chain alkyl alcohols; polyhydric alcohols such as sorbitol; fatty acid amides such as linoleamide, oleamide, and lauramide; saturated fatty acid bisamides such as methylenebisstearamide, ethylenebiscapramide, ethylenebislauramide, and hexamethylenebisstearamide; unsaturated fatty acid amides such as ethylenebisoleamide, hexamethylenebisoleamide, N,N'-dioleyladipamide, and N,N-dioleylsebacamide; aromatic bisamides such as m-xylenebisstearamide and N,N-distearylisophthalamide; fatty acid metal salts (generally known as metal soaps) such as calcium stearate, calcium laurate, zinc stearate, and magnesium stearate; waxes provided by grafting an aliphatic hydrocarbon wax using a vinylic monomer such as styrene or acrylic acid; partial esters between a polyhydric alcohol and a fatty acid, such as behenic monoglyceride; and hydroxyl group-containing methyl ester compounds obtained by the hydrogenation of plant oils.

Aliphatic hydrocarbon waxes are an example of waxes that are particularly preferred for use in the present invention. These aliphatic hydrocarbon waxes can be exemplified by the following: low molecular weight alkylene polymers provided by the radical polymerization of an alkylene under high pressures or provided by the polymerization of an alkylene at low pressures using a Ziegler catalyst; alkylene polymers obtained by the pyrolysis of high molecular weight alkylene polymer; synthetic hydrocarbon waxes obtained from the residual distillation fraction of hydrocarbon obtained by the Arge method from a synthesis gas containing carbon monoxide and hydrogen, and also the synthetic hydrocarbon waxes obtained by the hydrogenation of the former synthetic hydrocarbon waxes; and waxes provided by the fractionation of these aliphatic hydrocarbon waxes by a press sweating method, solvent method, use of vacuum distillation, or a fractional crystallization technique.

The following are examples of the hydrocarbon that can be used as the source for the aliphatic hydrocarbon wax: hydrocarbon synthesized by the reaction of carbon monoxide and hydrogen using a metal oxide catalyst (frequently a multicomponent system that is a binary or higher system) (for example, hydrocarbon compounds synthesized by the Synthol method or Hydrocol method (use of a fluidized catalyst bed)); hydrocarbon having up to about several hundred carbons, obtained by the Arge method, which produces large amounts of waxy hydrocarbon (use of a fixed catalyst bed); and hydrocarbon provided by the polymerization of an alkylene, e.g., ethylene, using a Ziegler catalyst. The following are specific examples: VISKOL (registered trademark) 330-P, 550-P, 660-P, and TS-200 (Sanyo Chemical Industries, Ltd.); Hi-WAX 400P, 200P, 100P, 410P, 420P, 320P, 220P, 210P, and 110P (Mitsui Chemicals, Inc.); Sasol H1, H2, C80, C105, and C77 (Sasol Wax GmbH); HNP-1, HNP-3, HNP-9, HNP-10, HNP-11, and HNP-12 (Nippon Seiro Co., Ltd.); UNILIN (registered trademark) 350, 425, 550, and 700 and UNICID (registered trademark) 350, 425, 550, and 700 (Toyo Petrolite Co., Ltd.); and Japan Wax, Beeswax, Rice Wax, Candelilla Wax, and Carnauba Wax (Cerarica NODA Co., Ltd.).

Among the preceding, in order to efficiently obtain a releasing effect, the incorporation is more preferred of a release agent that has a peak temperature for the endothermic peak for the release agent of at least 100° C.

With regard to the timing of release agent addition, in the case of toner production by the pulverization method the release agent may be added during melt-kneading or may be added during production of the resin for the toner. A single one of these release agents or a combination may be used. The release agent is preferably added at 1 mass part to 20 mass parts per 100 mass parts of the resin component containing the polyester resin composition.

A charge control agent may be used in the toner of the present invention in order to stabilize its triboelectric charging performance. While this will vary with the type of charge control agent and the properties of the other constituent materials of the toner particle, the charge control agent is generally incorporated, per 100 mass parts of the resin component that contains the polyester resin composition, preferably at from 0.1 mass parts to 10.0 mass parts and more preferably at from 0.1 mass parts to 5.0 mass parts.

Charge control agents that control toner to a negative charging performance and charge control agents that control toner to a positive charging performance are known, and one or two or more of various charge control agents can be used in conformity to the type of toner and its applications.

The following are examples of charge control agents for controlling the toner to a negative charging performance: organometal complexes (monoazo metal complexes, acetylacetone metal complexes) and the metal complexes and metal salts of aromatic hydroxycarboxylic acids and aromatic dicarboxylic acids. Additional examples for controlling the toner to a negative charging performance are aromatic mono- and polycarboxylic acids and their metal salts and anhydrides and phenol derivatives such as esters and bisphenols. Particularly preferred for use among the preceding are the metal complexes and metal salts of aromatic hydroxycarboxylic acids, which provide stable charging characteristics.

The following are examples of charge control agents for controlling the toner to a positive charging performance: nigrosine and its modifications by fatty acid metal salts; quaternary ammonium salts such as tributylbenzylammonium 1-hydroxy-4-naphthosulfonate and tetrabutylammonium tetrafluoroborate, and their analogues; onium salts such as phosphonium salts, and their lake pigments; triphenylmethane dyes and their lake pigments (the laking agent can be exemplified by phosphotungstic acid, phosphomolybdic acid, phosphotungstomolybdic acid, tannic acid, lauric acid, gallic acid, ferricyanic acid, and ferrocyanic compounds); and metal salts of higher fatty acids. A single one of these or a combination of two or more can be used by the present invention. Charge control agents such as nigrosine compounds and quaternary ammonium salts are preferred among the preceding for a charge control agent that controls the toner to a positive charging performance.

Specific examples are as follows: Spilon Black TRH, T-77, T-95, and TN-105 (Hodogaya Chemical Co., Ltd.); BONTRON (registered trademark)S-34, S-44, E-84, and E-88 (Orient Chemical Industries Co., Ltd.); TP-302 and TP-415 (Hodogaya Chemical Co., Ltd.); BONTRON (registered trademark)N-01, N-04, N-07, and P-51 (Orient Chemical Industries Co., Ltd.); and Copy Blue PR (Clariant).

A charge control resin may also be used, and it may also be used in combination with the charge control agents cited above. The toner of the present invention may be mixed with a carrier and used as a two-component developer. An ordinary carrier such as ferrite or magnetite or a resin-coated carrier can be used as the carrier. Also usable are binder-type carriers in which a magnetic powder is dispersed in a resin.

A resin-coated carrier is composed of a carrier core particle and a coating material, this latter being a resin that covers (coats) the surface of the carrier core particle. The resin used for this coating material can be exemplified by styrene-acrylic resins such as styrene-acrylate ester copolymers and styrene-methacrylate ester copolymers; acrylic resins such as acrylate ester copolymers and methacrylate ester copolymers; fluorine-containing resins such as polytetrafluoroethylene, monochlorotrifluoroethylene polymers, and polyvinylidene fluoride; silicone resins; polyester resins; polyamide resins; polyvinyl butyrals; and aminoacrylate resins. Additional examples are ionomer resins and polyphenylene sulfide resins. A single one of these resins may be used or a plurality may be used in combination.

In order to improve the charge stability, the durability of the developing performance, the flowability, and the durability, in a preferred embodiment of the toner of the present invention a silica fine powder is added to the toner particle as an external additive.

This silica fine powder has a specific surface area by the nitrogen adsorption-based BET method preferably of at least 30 $m^2/g$ and more preferably from 50 $m^2/g$ to 400 $m^2/g$. The silica fine powder is used, expressed per 100 mass parts of the toner particle, preferably at from 0.01 mass parts to 8.00 mass parts and more preferably at from 0.10 mass parts to 5.00 mass parts. The BET specific surface area of the silica fine powder can be determined using a multipoint BET method by the adsorption of nitrogen gas to the surface of the silica fine powder using, for example, an Autosorb 1 specific surface area analyzer (Yuasa Ionics Co., Ltd.), a GEMINI 2360/2375 (Micromeritics Instrument Corporation), or a TriStar-3000 (Micromeritics Instrument Corporation).

For the purpose of hydrophobing and controlling the triboelectric charging characteristics, the silica fine powder is optionally preferably also treated with a treatment agent, e.g., an unmodified silicone varnish, various modified silicone varnishes, an unmodified silicone oil, various modified silicone oils, a silane coupling agent, a functional group-bearing silane compound, or other organosilicon compounds, or with a combination of different treatment agents.

Other external additives may also be added to the toner of the present invention on an optional basis. These external additives can be exemplified by resin fine particles and inorganic fine powders that function as an auxiliary charging agents, agents that impart electroconductivity, flowability-imparting agents, anti-caking agents, release agents for hot roll fixing, lubricants, abrasive, and so on. The lubricant can be exemplified by polyethylene fluoride powders, zinc stearate powders, and polyvinylidene fluoride powders. The abrasive can be exemplified by cerium oxide powders, silicon carbide powders, and strontium titanate powders. Strontium titanate powders are preferred among the preceding.

The modification rate for the long-chain alkyl monomer was calculated in the present invention by measuring the hydroxyl value (or acid value). Specifically, the percentage (number of moles basis) for reacting hydroxyl groups (or carboxyl groups) per 1 molecule of the long-chain alkyl monomer was calculated using the hydroxyl value (or acid value).

With regard to the 1 molecule of the long-chain alkyl monomer, the calculations were carried using the average carbon chain length determined by measurement as 1 molecule.

EXAMPLES

The present invention is specifically described below using examples. However, the embodiments of the present invention are in no way limited to or by these examples. Unless specifically indicated otherwise, the number of parts and % in the examples and comparative examples are on a mass basis in all cases.

<Production Example for Long-Chain Alkyl Monomer (A-1)>

1200 g of a saturated chain hydrocarbon having an average carbon number of 35 was introduced into a cylindrical glass reactor; 38.5 g of boric acid was added at a temperature of 140° C.; and a mixed gas having an oxygen concentration of approximately 10% by volume, of 50% by volume air and 50% by volume nitrogen, was immediately injected at a rate of 20 L/minute and a reaction was carried out for 3.0 hours at 200° C. Subsequent to this, hot water was added to the reaction solution and a hydrolysis was carried out for 2 hours at 95° C. to obtain a reaction product (the modified product) as the upper layer after standing. 20 mass parts of the modified product was added to 100 mass parts of n-hexane and the unmodified component was dissolved and removed to obtain a long-chain alkyl monomer (A-1). The properties of the obtained long-chain alkyl monomer (A-1) are given in Table 1.

<Production Example for Long-Chain Alkyl Monomer (A-2)>

A long-chain alkyl monomer (A-2) was obtained proceeding as in the Production Example for Long-Chain Alkyl Monomer (A-1), but changing the conditions for purification with the n-hexane (extraction time and so forth) in the Production Example for Long-Chain Alkyl Monomer (A-1). The properties of the obtained long-chain alkyl monomer (A-2) are given in Table 1.

<Production Example for Long-Chain Alkyl Monomer (A-3)>

A long-chain alkyl monomer (A-3) was obtained by adding 20 mass parts of a primary long-chain alkyl monoalcohol having an average carbon number of 30 to 100 mass parts of n-hexane and dissolving and removing the unmodified component. The properties of the obtained long-chain alkyl monomer (A-3) are given in Table 1.

<Production Example for Long-Chain Alkyl Monomer (A-4)>

A long-chain alkyl monomer (A-4) was obtained proceeding as in the Production Example for Long-Chain Alkyl Monomer (A-3), with the exception that a long-chain alkyl monoalcohol having an average carbon number of 27 was used in the procedure of the Production Example for Long-Chain Alkyl Monomer (A-3). The properties of the obtained long-chain alkyl monomer (A-4) are given in Table 1.

<Production Example for Long-Chain Alkyl Monomer (A-5)>

A long-chain alkyl monomer (A-5) was obtained by adding 20 mass parts of a long-chain alkyl monocarboxylic acid having an average carbon number of 40 to 100 mass parts of n-hexane and dissolving and removing the unmodified component. The properties of the obtained long-chain alkyl monomer (A-5) are given in Table 1.

<Production Example for Long-Chain Alkyl Monomer (A-6)>

A long-chain alkyl monomer (A-6) was obtained by adding 20 mass parts of a long-chain alkyl monocarboxylic acid having an average carbon number of 50 to 100 mass parts of n-hexane and dissolving and removing the unmodified component. The properties of the obtained long-chain alkyl monomer (A-6) are given in Table 1.

<Production Example for Long-Chain Alkyl Monomer (A-7)>

1200 g of a saturated chain hydrocarbon having an average carbon number of 35 was introduced into a cylindrical glass reactor; 38.5 g of boric acid was added at a temperature of 140° C.; and a mixed gas having an oxygen concentration of approximately 10% by volume, of 50% by volume air and 50% by volume nitrogen, was immediately injected at a rate of 20 L/minute and a reaction was carried out for 2.5 hours at 170° C. Subsequent to this, hot water was added to the reaction solution and a hydrolysis was carried out for 2 hours at 95° C. to obtain a long-chain alkyl monomer (A-7). The properties of the obtained long-chain alkyl monomer (A-7) are given in Table 1.

<Production Example for Long-Chain Alkyl Monomer (A-8)>

1200 g of a saturated chain hydrocarbon having an average carbon number of 35 was introduced into a cylindrical glass reactor; 38.5 g of boric acid was added at a temperature of 140° C.; and a mixed gas having an oxygen concentration of approximately 10% by volume, of 50% by volume air and 50% by volume nitrogen, was immediately injected at a rate of 20 L/minute and a reaction was carried out for 2.5 hours at 175° C. Subsequent to this, hot water was added to the reaction solution and a hydrolysis was carried out for 2 hours at 95° C. to obtain a long-chain alkyl monomer (A-8). The properties of the obtained long-chain alkyl monomer (A-8) are given in Table 1.

<Production Example for Long-Chain Alkyl Monomer (A-9)>

A long-chain alkyl monomer (A-9) was obtained by adding 20 mass parts of a secondary long-chain alkyl monoalcohol having an average carbon number of 25 to 100 mass parts of n-hexane and dissolving and removing the unmodified component. The properties of the obtained long-chain alkyl monomer (A-9) are given in Table 1.

<Production Example for Long-Chain Alkyl Monomer (A-10)>

A long-chain alkyl monomer (A-10) was obtained by adding 20 mass parts of a secondary long-chain alkyl monoalcohol having an average carbon number of 55 to 100 mass parts of n-hexane and dissolving and removing the unmodified component. The properties of the obtained long-chain alkyl monomer (A-10) are given in Table 1.

<Production Example for Polyester Resin Composition (B-1)>

| | |
|---|---|
| ethylene oxide adduct on bisphenol A (2.0 mol adduct) | 50.0 mole parts |
| propylene oxide adduct on bisphenol A (2.3 mol adduct) | 50.0 mole parts |
| terephthalic acid | 60.0 mole parts |
| trimellitic anhydride | 20.0 mole parts |
| acrylic acid | 10.0 mole parts |

A mixture was prepared by the addition to 70 mass

A mixture was prepared by the addition to 70 mass parts of the above-listed polyester monomer of the long-chain alkyl monomer (A-1) so as to provide 5.0% by mass with reference to the overall polyester resin composition and was introduced into a four-neck flask; this was fitted with a pressure-reduction apparatus, a water separation apparatus, a nitrogen gas introduction apparatus, a temperature measurement apparatus, and a stirring apparatus; and stirring was carried out at 160° C. under a nitrogen atmosphere. The following was added dropwise to this from a dropping funnel over 4 hours: a mixture prepared by mixing 2.0 mol parts of benzoyl peroxide as a polymerization initiator with 30 mass parts of a vinyl polymer monomer (styrene: 60.0 mol parts, 2-ethylhexyl acrylate: 40.0 mol parts) for forming a vinyl polymer segment. This was followed by a reaction for 5 hours at 160° C.; the temperature was then raised to 230° C. and 0.05% by mass tetraisobutyl titanate was added; and the reaction time was controlled so as to provide the desired viscosity.

The completion of the reaction was followed by removal from the vessel, cooling, and pulverization to obtain a polyester resin composition (B-1). The properties of the obtained polyester resin composition (B-1) are given in Table 3.

<Production Example for Polyester Resin Compositions (B-2) to (B-7)>

Polyester resin compositions (B-2) to (B-7) were obtained proceeding as in the Production Example for Polyester Resin Composition (B-1), but changing to the monomer formulations as indicated in Table 2. The properties of the obtained polyester resin compositions (B-2) to (B-7) are shown in Table 3.

<Production Example for Polyester Resin Composition (B-8)>

| | |
|---|---|
| ethylene oxide adduct on bisphenol A (2.0 mol adduct) | 40.0 mole parts |
| propylene oxide adduct on bisphenol A (2.3 mol adduct) | 60.0 mole parts |
| terephthalic acid | 60.0 mole parts |
| trimellitic anhydride | 20.0 mole parts |
| acrylic acid | 10.0 mole parts |

50 mass parts of the above-listed polyester monomer mixture was introduced into a four-neck flask; a pressure-reduction apparatus, a water separation apparatus, a nitrogen gas introduction apparatus, a temperature measurement apparatus, and a stirring apparatus were installed; and stirring was carried out at 160° C. under a nitrogen atmosphere. The following was added dropwise to this from a dropping funnel over 4 hours: a mixture prepared by mixing 2.0 mol parts of benzoyl peroxide as a polymerization initiator with 50 mass parts of a vinyl polymer monomer (styrene: 60.0 mol parts, 2-ethylhexyl acrylate: 40.0 mol parts) for forming a vinyl polymer segment. This was followed by a reaction for 5 hours at 160° C.; the temperature was then raised to 230° C. and 0.05% by mass tetraisobutyl titanate was added; and the reaction time was controlled so as to provide the desired viscosity.

The long-chain alkyl monomer (A-3) was then added so as to provide 10.0% by mass with respect to the overall polyester resin composition and the temperature was raised to 200° C. under reduced pressure and the reaction time was controlled so as to provide the desired viscosity. The completion of the reaction was followed by removal from the vessel, cooling, and pulverization to obtain a polyester resin composition (B-8). The properties of the obtained polyester resin composition (B-8) are given in Table 3.

<Production Example for Polyester Resin Composition (B-9)>

Polyester resin composition (B-9) was obtained proceeding as in the Production Example for Polyester Resin Composition (B-8), but changing to the monomer formulation as indicated in Table 2. The properties of the obtained polyester resin composition (B-9) are shown in Table 3.

<Polyester Resin Composition (B-10)>

The monomer indicated in Table 2 was introduced into a 5 liter autoclave along with tetraisobutyl titanate at 0.05% by mass with respect to the total amount of monomer; a reflux condenser, water separation apparatus, nitrogen gas introduction tube, thermometer, and stirring apparatus were installed; and a polycondensation reaction was carried out at 230° C. while introducing nitrogen gas into the autoclave. The reaction time was controlled so as to provide the desired softening point. Subsequent to this, the long-chain alkyl monomer (A-5) was added so as to provide 2.5% by mass with respect to the overall polyester resin composition; the temperature was raised to 200° C. under reduced pressure; and the reaction time was controlled so as to provide the desired viscosity. The completion of the reaction was followed by removal from the vessel, cooling, and pulverization to obtain a polyester resin composition (B-10). The properties of the obtained polyester resin composition (B-10) are given in Table 3.

<Production Example for Polyester Resin Composition (B-11)>

Polyester resin composition (B-11) was obtained proceeding as in the Production Example for Polyester Resin Composition (B-10), but changing to the monomer formulation as indicated in Table 2. The properties of the obtained polyester resin composition (B-11) are shown in Table 3.

<Production Example for Polyester Resin Compositions (B-12) to (B-17)>

Polyester resin compositions (B-12) to (B-17) were obtained proceeding as in the Production Example for Polyester Resin Composition (B-1), but changing to the monomer formulations as indicated in Table 2. The properties of the obtained polyester resin compositions (B-12) to (B-17) are shown in Table 3.

<Production Example for Polyester Resin Composition (B-18)>

| | |
|---|---|
| ethylene oxide adduct on bisphenol A (2.0 mol adduct) | 10.0 mole parts |
| propylene oxide adduct on bisphenol A (2.3 mol adduct) | 32.5 mole parts |
| ethylene glycol | 25.0 mole parts |
| terephthalic acid | 40.5 mole parts |
| isophthalic acid | 0.5 mole parts |
| trimellitic anhydride | 9.0 mole parts |

"UNILIN 700" (Toyo Petrolite Co., Ltd.) was added, so as to provide 3.0% by mass with respect to the overall polyester resin composition, to the above-listed acid component and alcohol component of the charge composition in a reactor equipped with a distillation column, and antimony trioxide was introduced at 1500 ppm with respect to the overall acid component. Then, while holding the rotation rate of the stirring blade in the reactor at 120 rpm, temperature ramp up was started and heating was carried out to bring the temperature in the reaction system to 265° C. and this temperature was maintained. The esterification reaction began with the distillation of water from the reaction system and the reaction was finished when the distillation of water ceased. The temperature in the reaction system was then reduced and was held at 235° C.; the pressure within the reactor was reduced over about 40 minutes to reach a vacuum of 133 Pa; and a condensation reaction was carried out while distilling the diol component from the reaction system. The viscosity of the reaction system rose as the reaction progressed and the vacuum was increased as the viscosity rose; and the condensation reaction was run until the stirring blade torque assumed a value that corresponded to the desired softening temperature. Stirring was stopped when the prescribed torque was indicated and the reaction system was returned to normal pressure and the reaction product was removed over about 40 minutes by pressurization with nitrogen to obtain a polyester resin composition (B-18).

The properties of the obtained polyester resin composition (B-18) are given in Table 3.

<Production Example for Polyester Resin Composition (B-19)>

Polyester resin composition (B-19) was obtained proceeding as in the Production Example for Polyester Resin Composition (B-10), but changing to the monomer formulation as indicated in Table 2. The properties of the obtained polyester resin composition (B-19) are shown in Table 3.

<Production Example for Polyester Resin Composition (B-20)>

Polyester resin composition (B-20) was obtained proceeding as in the Production Example for Polyester Resin Composition (B-1), but changing to the monomer formulation as indicated in Table 2. The properties of the obtained polyester resin composition (B-20) are shown in Table 3.

<Example 1>

| | |
|---|---|
| polyester resin composition (B-1) | 100.0 mass parts |
| magnetic iron oxide particles (octahedral shape) (number-average particle diameter = 0.13 μm, Hc = 11.5 kA/m, σs = 88 $Am^2/kg$, σr = 14 $Am^2/kg$) | 60.0 mass parts |
| release agent, Fischer-Tropsch wax (Sasol Wax GmbH, C105, melting point = 105° C.) | 2.0 mass parts |
| charge control agent (T-77, Hodogaya Chemical Co., Ltd.) | 2.0 mass parts |

These materials were preliminarily mixed with a Henschel mixer and were then melt-kneaded using a twin-screw kneading extruder (Model PCM-30 from Ikegai Ironworks Corporation).

The resulting kneaded material was cooled and was coarsely pulverized using a hammer mill and was then pulverized using a mechanical pulverizer (T-250 from Turbo Kogyo Co., Ltd.). The obtained finely pulverized powder was classified using a multi-grade classifier based on the Coanda effect to obtain negative-charging toner particles having a weight-average particle diameter (D4) of 7.0 μm. 1.0 mass part of a hydrophobic silica fine powder 1 [BET specific surface area=150 $m^2/g$, obtained by a hydrophobic treatment with 30 mass parts of hexamethyldisilazane (HMDS) and 10 mass parts of dimethylsilicone oil per 100 mass parts of the silica fine powder] and 0.6 mass parts of a strontium titanate fine powder (median diameter: 1.0 μm) were externally added and mixed with 100 mass parts of the toner particles using a Henschel mixer (Model FM-75 from Nippon Coke & Engineering Co., Ltd.) followed by screening on a mesh with an aperture of 150 to obtain a toner (T-1).

The obtained toner (T-1) was evaluated as follows.

<Test of the Low-Temperature Fixability>

For the low-temperature fixability, an external fixing unit was used: this was obtained by removing the fixing unit of a Hewlett-Packard laser printer (HP LaserJet Enterprise 600 M603) to the outside and was modified to enable the temperature of the fixing unit to be freely set and to provide a process speed of 500 mm/sec.

Using this device, an unfixed image having a toner laid-on level per unit area set to 0.5 $mg/cm^2$ was passed through the fixing unit, which was controlled to a temperature of 160° C.; this was done in a normal-temperature, normal-humidity environment (temperature=23.5° C., humidity=60% RH) or in a low-temperature, low-humidity environment (temperature=15° C., humidity=10% RH). "Plover Bond Paper" (105 $g/m^2$, Fox River Paper Co.) was used as the recording medium. The resulting fixed image was rubbed with lens-cleaning paper under a load of 4.9 kPa (50 $g/cm^2$), and the reduction (%) in the image density pre-versus-post-rubbing was evaluated. The image density was measured using a MacBeth densitometer (MacBeth Corporation), which is a reflection densitometer, and an SPI filter.

A (very good): The reduction in the image density is less than 5.0%.

B (good): The reduction in the image density is at least 5.0% but less than 10.0%.

C (ordinary): The reduction in the image density is at least 10.0% but less than 15.0%.

D (poor): The reduction in the image density is at least 15.0%.

The results are given in Table 5.

<Evaluation of Fixing Unit Contamination>

For the evaluation of contamination at the fixing unit, an evaluation machine was used that was provided by the modification of a Hewlett-Packard laser printer (HP LaserJet Enterprise 600 M603) to give a print speed of 75 sheets/minute and a fixation control temperature of 220° C.

Using this evaluation machine, 250,000 prints of a test chart having a print percentage of 12% were output in a normal-temperature, normal-humidity environment (temperature=23.5° C., humidity=60% RH). The cartridge was changed each time the toner was exhausted and printing was then continued.

The status of contamination around the fixing unit was visually inspected after printing and was evaluated according to the following criteria.

A (very good): Noticeable contamination around the fixing unit is not seen.

B (good): Very minor contamination around the fixing unit is observed.

C (ordinary): The spread of contamination to the fixing guide section is clearly observed.

D (poor): A significant amount of contamination around the fixing unit is noticeable.

The results are given in Table 5.

<Evaluation Test for the Storability>

10 g of the toner was weighed into a 50-cc plastic cup and was held for 3 days in a 55° C. thermostat. The toner was visually inspected after standing and the storability was evaluated using the following criteria.

A (very good): Loosening occurs immediately when the cup is rotated.

B (good): Clumps are present, but are reduced in size and loosening occurs during cup rotation.

C (ordinary): Clumps remain even though loosening occurs when the cup is rotated.

D (poor): Large clumps are present and loosening does not occur even when the cup is rotated.

The results are given in Table 5.

<Evaluation of the Developing Performance in a High-Temperature, High-Humidity Environment and Evaluation of the Standing Stability in a High-Temperature, High-Humidity Environment>

Using a Hewlett-Packard laser printer (HP LaserJet Enterprise 600 M603), 500 prints of a test chart were made in a high-temperature, high-humidity environment (temperature=32.5° C., humidity=80% RH), and the reflection density in a solid black region on the test chart was measured. The average at five points was calculated and was evaluated according to the following criteria.

A (very good): the average value of the image density is at least 1.45

B (good): the average value of the image density is at least 1.35 but less than 1.45

C (ordinary): the average value of the image density is at least 1.25 but less than 1.35

D (poor): the average value of the image density is less than 1.25

This was followed by standing for 72 hours in the same environment and then output of the test chart again. The reflection density of the solid black region was measured, and the reduction in the image density post-standing was determined with respect to the image density pre-standing and was evaluated according to the following criteria.

A (very good): The reduction in the image density is less than 3.0%.

B (good): The reduction in the image density is at least 3.0% but less than 6.0%.

C (ordinary): The reduction in the image density is at least 6.0% but less than 10.0%.

D (poor): The reduction in the image density is at least 10.0%.

<Examples 2 to 11>

Toners (T-2) to (T-11) were produced proceeding as in Example 1 and using the formulations indicated in Table 4. The same evaluations as in Example 1 were run on the resulting toners. The results are given in Table 5.

<Example 12> polyester resin composition (B-2) 100 mass parts carbon black 5 mass parts release agent, Fischer-Tropsch wax 2 mass parts (Sasol Wax GmbH, C105, melting point=105° C.)

charge control agent (T-77, Hodogaya Chemical Co., Ltd.) 2 mass parts

These materials were preliminarily mixed with a Henschel mixer and were then melt-kneaded using a twin-screw kneading extruder.

The resulting kneaded material was cooled and was coarsely pulverized using a hammer mill and was then pulverized using a jet mill. The obtained finely pulverized powder was classified using a multi-grade classifier based on the Coanda effect to obtain negative-charging toner particles having a weight-average particle diameter (D4) of 7.0

To 100 mass parts of the obtained toner particles were added 1.0 mass part of titanium oxide fine particles that had a number-average primary particle diameter of 50 nm and that had been surface-treated with 15% by mass of isobutyltrimethoxysilane and also 0.8 mass parts of hydrophobic silica fine particles that had a number-average primary particle diameter of 16 nm and that had been surface-treated with 20% by mass of hexamethyldisilazane, and mixing and external addition were carried out using a Henschel mixer (Model FM-75 from Nippon Coke & Engineering Co., Ltd.) followed by screening on a mesh with an aperture of 150 μm to obtain a toner (T-12).

The evaluation of toner (T-12) was carried out as in Example 1, but changing over to the conditions as indicated below.

<Test of the Low-Temperature Fixability>

The evaluation was carried out as in Example 1, but changing the temperature of the fixing unit in the evaluation procedure of Example 1 to 140° C. The results are given in Table 5.

<Evaluation of Fixing Unit Contamination>

With respect to evaluating the durability of the developing performance, the evaluation was performed as in Example 1, but using an evaluation machine provided by the modification of a Hewlett-Packard laser printer (HP Color LaserJet CP6015xh) to 75 sheets/minute and a fixation temperature of 220° C. The results are given in Table 5.

<Evaluation Test for the Storability>

The storability was evaluated as in Example 1. The results of the evaluation are given in Table 5.

<Change in the Image Density Pre-Versus-Post-Standing in a High-Temperature, High-Humidity Environment>

The evaluation was performed as in Example 1, but changing the evaluation machine in the evaluation procedure of Example 1 to a Hewlett-Packard laser printer (HP Color LaserJet CP6015xh). The results are given in Table 5.

<Comparative Examples 1 to 6>

Toners (T-13) to (T-18) were produced as in Example 1 using the formulations given in Table 4. The same evaluations as in Example 1 were carried out on the obtained toners. The results are given in Table 6.

<Comparative Example 7>

Toner (T-19) was produced as in Example 12 using the formulation given in Table 4. The same evaluations as in Example 12 were performed on the obtained toner. The results are given in Table 6.

TABLE 1

| Long-chain alkyl monomer No. | Type of long-chain alkyl | Carbon number | Modification rate (%) | Hydroxyl value (mg KOH/g) | Acid value (mg KOH/g) |
|---|---|---|---|---|---|
| A-1 | Saturated monoalcohol modification product (secondary) | 35 | 93.7 | 115 | — |
| A-2 | Saturated monoalcohol modification product (secondary) | 35 | 77.4 | 95 | — |
| A-3 | Saturated monoalcohol modification product (primary) | 30 | 91.5 | 131 | — |
| A-4 | Saturated monoalcohol modification product (primary) | 27 | 90.6 | 144 | — |
| A-5 | Saturated monocarboxylic acid modification product | 40 | 90.2 | — | 97 |
| A-6 | Saturated monocarboxylic acid modification product | 50 | 91.8 | — | 79 |
| A-7 | Saturated monoalcohol modification product (secondary) | 35 | 49.7 | 61 | — |
| A-8 | Saturated monoalcohol modification product (secondary) | 35 | 61.1 | 75 | — |
| A-9 | Saturated monoalcohol modification product (secondary) | 25 | 90.9 | 156 | — |
| A-10 | Saturated monoalcohol modification product (secondary) | 55 | 93.3 | 73 | — |
| A-11(*) | Saturated monoalcohol modification product (primary) | 48 | 80.3 | 72 | — |

(*)A-11: UNILIN 700 (Toyo Petrolite Co., Ltd.)

TABLE 2

| Polyester resin composition No. | Polyester resin components, charge composition (*1) BPA-PO (mole parts) | BPA-EO (mole parts) | EG (mole parts) | TPA (mole parts) | IPA (mole parts) | TMA (mole parts) | Acrylic acid (mole parts) | Long-chain alkyl monomer Designation | (mass %) (*3) | StAc resin components, charge composition (*2) St (mole parts) | 2EHA (mole parts) | PES/StAc ratio |
|---|---|---|---|---|---|---|---|---|---|---|---|---|
| B-1 | 50.0 | 50.0 | — | 60.0 | — | 20.0 | 10.0 | A-1 | 5.0 | 60 | 40 | 70/30 |
| B-2 | 50.0 | 50.0 | — | 60.0 | — | 20.0 | 10.0 | A-1 | 5.0 | 60 | 40 | 70/30 |
| B-3 | 100 | 0.0 | — | 60.0 | | 20.0 | 20.0 | A-1 | 5.0 | 100 | — | 60/40 |
| B-4 | 50.0 | 50.0 | — | 60.0 | — | 20.0 | 10.0 | A-1 | 7.5 | 60 | 40 | 70/30 |
| B-5 | 50.0 | 50.0 | — | 60.0 | — | 20.0 | 10.0 | A-1 | 10.0 | 60 | 40 | 70/30 |
| B-6 | 50.0 | 50.0 | — | 60.0 | — | 20.0 | 10.0 | A-1 | 2.5 | 60 | 40 | 70/30 |
| B-7 | 50.0 | 50.0 | — | 60.0 | — | 20.0 | 10.0 | A-2 | 5.0 | 60 | 40 | 70/30 |
| B-8 | 60.0 | 40.0 | — | 60.0 | — | 20.0 | 10.0 | A-3 | 10.0 | 60 | 40 | 50/50 |
| B-9 | 70.0 | 30.0 | — | 60.0 | — | 18.0 | 10.0 | A-4 | 10.0 | 60 | 40 | 40/60 |
| B-10 | 40.0 | 60.0 | — | 60.0 | — | 22.0 | — | A-5 | 2.5 | — | — | 100/0 |
| B-11 | 30.0 | 70.0 | — | 60.0 | — | 24.0 | — | A-6 | 2.5 | — | — | 100/0 |
| B-12 | 50.0 | 50.0 | — | 60.0 | — | 20.0 | 10.0 | A-7 | 5.0 | 60 | 40 | 70/30 |
| B-13 | 50.0 | 50.0 | — | 60.0 | — | 20.0 | 10.0 | A-8 | 5.0 | 60 | 40 | 70/30 |
| B-14 | 50.0 | 50.0 | — | 60.0 | — | 18.0 | 10.0 | A-1 | 2.0 | 60 | 40 | 70/30 |
| B-15 | 50.0 | 50.0 | — | 60.0 | — | 20.0 | 10.0 | A-1 | 10.5 | 60 | 40 | 70/30 |
| B-16 | 50.0 | 50.0 | — | 60.0 | — | 20.0 | 10.0 | A-9 | 2.0 | 60 | 40 | 70/30 |
| B-17 | 50.0 | 50.0 | — | 60.0 | — | 20.0 | 10.0 | A-10 | 5.0 | 60 | 40 | 70/30 |
| B-18 | 32.5 | 10.0 | 25.0 | 40.5 | 0.5 | 9.0 | — | A-11 | 3.0 | — | — | 100/0 |
| B-19 | 35.0 | 45.0 | 20.0 | 85.0 | — | — | — | — | — | — | — | 100/0 |
| B-20 | 50.0 | 50.0 | — | 80.0 | — | — | 10.0 | A-1 | 5.0 | 60 | 40 | 70/30 |

BPA-PO: bisphenol A/propylene oxide adduct (2.3 mol adduct)
BPA-EO: bisphenol A/ethylene oxide adduct (2.0 mol adduct)
EG: ethylene glycol
TPA: terephthalic acid
IPA: isophthalic acid
TMA: trimellitic anhydride
St: styrene
2EHA: 2-ethylhexyl acrylate
(*1): The mole parts of monomer in the table gives the ratio where the total amount of the alcohol components (excluding the long-chain alkyl monomer) is 100 mole parts.
(*2): The mole parts of monomer in the table gives the ratio where the total amount of the StAc resin components is 100 mole parts.
(*3): The amount of addition of the long-chain alkyl monomer represents the % by mass with respect to the overall polyester resin composition.

TABLE 3

| Polyester resin composition No. | Tg (° C.) | Tm (° C.) | Acid value (mg KOH/g) | DSC peak temperature (° C.) | Endothermic quantity for the DSC peak (J/g) |
|---|---|---|---|---|---|
| B-1 | 54.9 | 131.5 | 23.0 | 75.6 | 0.61 |
| B-2 | 54.3 | 115.6 | 23.6 | 75.9 | 0.65 |
| B-3 | 56.5 | 130.5 | 23.2 | 75.0 | 0.22 |
| B-4 | 55.6 | 114.3 | 18.3 | 75.3 | 1.23 |
| B-5 | 53.6 | 116.5 | 16.4 | 74.8 | 1.89 |
| B-6 | 57.0 | 115.6 | 29.1 | 76.1 | 0.12 |
| B-7 | 55.3 | 116.3 | 25.0 | 74.9 | 1.45 |
| B-8 | 56.3 | 116.8 | 16.4 | 65.7 | 1.75 |
| B-9 | 55.6 | 115.6 | 14.3 | 60.5 | 1.89 |
| B-10 | 56.0 | 115.7 | 31.5 | 81.5 | 0.15 |
| B-11 | 55.7 | 116.2 | 33.5 | 89.5 | 0.19 |

TABLE 3-continued

| Polyester resin composition No. | Tg (° C.) | Tm (° C.) | Acid value (mg KOH/g) | DSC peak temperature (° C.) | Endothermic quantity for the DSC peak (J/g) |
|---|---|---|---|---|---|
| B-12 | 56.3 | 116.5 | 28.6 | 75.9 | 2.91 |
| B-13 | 55.6 | 115.6 | 25.3 | 74.7 | 2.15 |
| B-14 | 57.6 | 116.5 | 31.5 | 75.2 | 0.04 |
| B-15 | 57.0 | 117.5 | 14.3 | 76.0 | 2.05 |
| B-16 | 51.4 | 112.6 | 20.5 | 55.2 | 0.05 |
| B-17 | 57.7 | 117.3 | 25.2 | 95.4 | 1.98 |
| B-18 | 57.3 | 117.3 | 2.1 | 105.3 | 3.22 |
| B-19 | 53.6 | 90.6 | 12.5 | — | — |
| B-20 | 53.5 | 90.2 | 15.3 | 75.3 | 0.54 |

TABLE 4

| Toner No. | T-1 | T-2 | T-3 | T-4 | T-5 | T-6 | T-7 | T-8 | T-9 | T-10 |
|---|---|---|---|---|---|---|---|---|---|---|
| Polyester resin compostion 1 | B-1 | B-2 | B-3 | B-4 | B-5 | B-6 | B-7 | B-8 | B-9 | B-10 |
| Polyester resin composition 2 | B-19 | | B-20 | — | — | — | — | — | — | — |
| Number of parts of resin 1/number of parts of resin 2 | 55/45 | 100/0 | 70/30 | 100/0 | 100/0 | 100/0 | 100/0 | 100/0 | 100/0 | 100/0 |

| Toner No. | T-11 | T-12 | T-13 | T-14 | T-15 | T-16 | T-17 | T-18 | T-19 |
|---|---|---|---|---|---|---|---|---|---|
| Polyester resin compostion 1 | B-11 | B-2 | B-12 | B-13 | B-14 | B-15 | B-16 | B-17 | B-18 |

TABLE 4-continued

| | | | | | | | | | |
|---|---|---|---|---|---|---|---|---|---|
| Polyester resin composition 2 | — | — | — | — | — | — | — | — | — |
| Number of parts of resin 1/number of parts of resin 2 | 100/0 | 100/0 | 100/0 | 100/0 | 100/0 | 100/0 | 100/0 | 100/0 | 100/0 |

TABLE 5

| | | Example 1 | Example 2 | Example 3 | Example 4 | Example 5 | Example 6 | Example 7 | Example 8 | Example 9 | Example 10 | Example 11 | Example 12 |
|---|---|---|---|---|---|---|---|---|---|---|---|---|---|
| Low-temperature fixability (upper row: rank/lower row: density reduction (%)) | Normal temperature Normal humidity | A<br>1.5 | A<br>1.6 | A<br>1.7 | A<br>1.3 | A<br>1.2 | B<br>6.5 | B<br>5.3 | A<br>3.5 | A<br>4.5 | B<br>6.3 | C<br>10.5 | A<br>1.8 |
| | Low temperature Low humidity | A<br>2.4 | A<br>2.5 | A<br>2.6 | A<br>2.0 | A<br>1.9 | B<br>7.3 | B<br>6.5 | B<br>5.3 | C<br>10.2 | C<br>11.3 | C<br>14.8 | A<br>2.6 |
| Contamination of fixing unit | | A | A | A | B | C | A | B | C | C | A | A | A |
| Storability | | A | A | B | B | C | A | A | C | C | B | B | A |
| HH density (upper row: rank/lower row: image density) | | A<br>1.50 | A<br>1.51 | A<br>1.49 | A<br>1.48 | A<br>1.50 | A<br>1.47 | A<br>1.46 | A<br>1.50 | A<br>1.47 | B<br>1.42 | B<br>1.42 | A<br>1.49 |
| Density reduction (upper row: rank/lower row: density reduction (%)) | | A<br>2.5 | A<br>2.2 | A<br>2.6 | B<br>3.5 | C<br>6.5 | C<br>6.9 | A<br>2.1 | C<br>7.2 | D<br>10.5 | D<br>11.5 | D<br>12.2 | A<br>2.1 |

TABLE 6

| | | Comparative Example 1 | Comparative Example 2 | Comparative Example 3 | Comparative Example 4 | Comparative Example 5 | Comparative Example 6 | Comparative Example 7 |
|---|---|---|---|---|---|---|---|---|
| Low-temperature fixability (upper row: rank/lower row: density reduction (%)) | Normal temperature Normal humidity | C<br>11.5 | C<br>12.1 | D<br>15.6 | C<br>10.5 | D<br>16.3 | D<br>18.3 | C<br>11.6 |
| | Low temperature Low humidity | C<br>12.3 | C<br>12.9 | D<br>16.5 | C<br>11.6 | D<br>17.1 | D<br>19.2 | C<br>12.5 |
| Contamination of fixing unit | | D | D | A | D | A | D | D |
| Storability | | A | A | A | D | D | A | B |
| HH density (upper row: rank/lower row: image density) | | A<br>1.48 | A<br>1.46 | A<br>1.47 | A<br>1.46 | A<br>1.48 | A<br>1.47 | B<br>1.40 |
| Density reduction (upper row: rank/lower row: density reduction (%)) | | A<br>2.5 | A<br>2.7 | D<br>10.9 | D<br>10.8 | A<br>2.6 | A<br>2.5 | D<br>11.5 |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. A toner, comprising:

a toner particle comprising a polyester resin composition with a percentage ratio of a total content of aliphatic hydrocarbon having an average carbon number of 27 to 50 and long-chain alkyl group to a mass of the polyester resin composition of 2.5 to 10.0% by mass, the polyester resin composition having a peak top temperature of an endothermic peak in a differential scanning calorimetric chart thereof of 60.0 to 90.0° C. with an endothermic quantity of the endothermic peak being 0.10 to 1.90 J/g, the polyester resin composition being obtained by at least one process selected from the group of processes I to IV, wherein process I comprises:

(i) providing a composition (C) containing a long-chain alkyl monoalcohol having an average carbon number of 27 to 50, and an aliphatic hydrocarbon having an average carbon number of 27 to 50; and (ii) mixing composition (C) with a polyester resin having a carboxyl group at the terminal end to react the long-chain alkyl monoalcohol with the carboxyl group to obtain a polyester resin having a long-chain alkyl group at the terminal thereof, process II comprises:

(iii) providing a composition (D) containing a long chain-alkyl monocarboxylic acid having an average carbon number of 27 to 50, and an aliphatic hydrocarbon having an average carbon number of 27 to 50; and (iv) mixing composition (D) with a polyester resin having a hydroxyl group at the terminal end to react the long-chain alkyl monocarboxylic acid with the hydroxyl group to obtain a polyester resin having a long-chain alkyl group at the terminal thereof, process III comprises:

(v) providing a composition (E) containing a long-chain alkyl monoalcohol having an average carbon number of 27 to 50, and an aliphatic hydrocarbon having an average carbon number of 27 to 50; and (vi) mixing composition (E) with a diol and a dicarboxylic acid to react the dicarboxylic acid with the long-chain alkyl monoalcohol and the diol to obtain a polyester resin having a long-chain alkyl group at the terminal thereof, and process IV comprises:

(vii) providing a composition (F) containing a long-chain alkyl monocarboxylic acid having an average carbon number of 27 to 50, and an aliphatic hydrocarbon having an average carbon number of 27 to 50; and (viii) mixing composition (F) with a diol and a dicarboxylic acid to react the diol with the dicarboxylic acid and the long-chain alkyl monocarboxylic acid to obtain a polyester resin having a long-chain alkyl group at the terminal thereof.

2. The toner according to claim 1, where the polyester resin composition is prepared according to process I.

3. The toner according to claim 1, where the polyester resin composition is prepared according to process II.

4. The toner according to claim 1, where the polyester resin composition is prepared according to process III.

5. The toner according to claim 1, where the polyester resin composition is prepared according to process IV.

6. A process for manufacturing a toner, comprising the steps of:

(I) producing a polyester resin composition with a percentage ratio of a total content of aliphatic hydrocarbon having an average carbon number of 27 to 50 and long-chain alkyl group to a mass of the polyester resin composition of 2.5 to 10.0% by mass, the polyester resin composition having a peak top temperature of an endothermic peak in a differential scanning calorimetric chart thereof of 60.0 to 90.0° C. with an endothermic quantity of the endothermic peak being 0.10 to 1.90 J/g, step (I) including at least one sub-process selected from the group of sub-processes Ito IV;

(II) melt-kneading the polyester resin composition and a colorant to obtain a melt-kneaded material; and (III) pulverizing the melt-kneaded material to obtain a toner particle, wherein sub-process I comprises:

(i) providing a composition (C) containing a long-chain alkyl monoalcohol having an average carbon number of 27 to 50, and an aliphatic hydrocarbon having an average carbon number of 27 to 50; and (ii) mixing composition (C) with a polyester resin having a carboxyl group at the terminal end to react the long-chain alkyl monoalcohol with the carboxyl group to obtain a polyester resin having a long-chain alkyl group at the terminal thereof, process II comprises:

(iii) providing a composition (D) containing a long chain-alkyl monocarboxylic acid having an average carbon number of 27 to 50, and an aliphatic hydrocarbon having an average carbon number of 27 to 50; and (iv) mixing composition (D) with a polyester resin having a hydroxyl group at the terminal end to react the long-chain alkyl monocarboxylic acid with the hydroxyl group to obtain a polyester resin having a long-chain alkyl group at the terminal thereof, process III comprises:

(v) providing a composition (E) containing a long-chain alkyl monoalcohol having an average carbon number of 27 to 50, and an aliphatic hydrocarbon having an average carbon number of 27 to 50; and (vi) mixing composition (E) with a diol and a dicarboxylic acid to react the dicarboxylic acid with the long-chain alkyl monoalcohol and the diol to obtain a polyester resin having a long-chain alkyl group at the terminal thereof, and process IV comprises:

(vii) providing a composition (F) containing a long-chain alkyl monocarboxylic acid having an average carbon number of 27 to 50, and an aliphatic hydrocarbon having an average carbon number of 27 to 50; and (viii) mixing composition (F) with a diol and a dicarboxylic acid to react the diol with the dicarboxylic acid and the long-chain alkyl monocarboxylic acid to obtain a polyester resin having a long-chain alkyl group at the terminal thereof.

7. The process according to claim 6, where the polyester resin composition is prepared according to process I.

8. The process according to claim 6, where the polyester resin composition is prepared according to process II.

9. The process according to claim 6, where the polyester resin composition is prepared according to process III.

10. The process according to claim 6, where the polyester resin composition is prepared according to process IV.

* * * * *